US008714715B2

(12) United States Patent
Koseki

(10) Patent No.: US 8,714,715 B2
(45) Date of Patent: May 6, 2014

(54) LIQUID JET HEAD, LIQUID JET APPARATUS, AND METHOD OF MANUFACTURING LIQUID JET HEAD

(75) Inventor: Osamu Koseki, Chiba (JP)

(73) Assignee: Sii Printek Inc. (JP)

( * ) Notice: Subject to any disclaimer, the term of this patent is extended or adjusted under 35 U.S.C. 154(b) by 0 days.

(21) Appl. No.: 13/534,139

(22) Filed: Jun. 27, 2012

(65) Prior Publication Data

US 2013/0002769 A1 Jan. 3, 2013

(30) Foreign Application Priority Data

Jun. 28, 2011 (JP) ..... 2011-143200

(51) Int. Cl.
*B41J 2/045* (2006.01)

(52) U.S. Cl.
USPC ..... 347/71; 347/68; 347/72; 347/69

(58) Field of Classification Search
USPC ..... 347/68–72
See application file for complete search history.

(56) References Cited

U.S. PATENT DOCUMENTS

| | | | | |
|---|---|---|---|---|
| 5,787,558 | A | 8/1998 | Murphy | 29/25.35 |
| 2003/0193550 | A1* | 10/2003 | Harajiri et al. | 347/68 |
| 2009/0315957 | A1* | 12/2009 | Koseki | 347/68 |

FOREIGN PATENT DOCUMENTS

| | | |
|---|---|---|
| EP | 1470920 | 10/2004 |
| JP | 3272857 | 12/1991 |
| JP | 4307254 | 10/1992 |
| JP | 4263742 | 5/2009 |
| JP | 4467860 | 5/2010 |
| JP | 4658324 | 3/2011 |
| WO | 0029217 | 5/2000 |
| WO | 0112442 | 2/2001 |
| WO | 2005007415 | 1/2005 |

OTHER PUBLICATIONS

EPO Search Report mailed May 10, 2013 issued in EPC Appln. No. EP 12 17 4146.

* cited by examiner

*Primary Examiner* — Henok Legesse
(74) *Attorney, Agent, or Firm* — Adams & Wilks

(57) ABSTRACT

A liquid jet head has a nozzle plate including nozzles for ejecting liquid and side walls placed over the nozzle plate, the side walls forming grooves having a fixed depth in a longitudinal direction thereof. Drive electrodes are formed on wall surfaces of the side walls. A cover plate is placed on upper surfaces of the side walls and has a supply port for supplying liquid to the grooves and a discharge port for discharging liquid from the grooves. Sealing materials are placed for closing the grooves outside communicating portions between the grooves and the supply port and between the grooves and the discharge port to prevent leakage of liquid from the grooves.

21 Claims, 12 Drawing Sheets

LIQUID JET HEAD, LIQUID JET APPARATUS, AND METHOD OF MANUFACTURING LIQUID JET HEAD

BACKGROUND OF THE INVENTION

1. Field of the Invention

The present invention relates to a liquid jet head for ejecting a liquid from a nozzle to form images, characters, or a thin film material onto a recording medium. The present invention relates also to a liquid jet apparatus using the liquid jet head, and to a method of manufacturing a liquid jet head.

2. Description of the Related Art

In recent years, there has been used an ink-jet type liquid jet head for ejecting ink droplets on recording paper or the like to render characters or graphics thereon, or for ejecting a liquid material on a surface of an element substrate to form a functional thin film thereon. In such a liquid jet head, ink or a liquid material is supplied from a liquid tank via a supply tube to the liquid jet head, and ink or a liquid material filled into a channel is ejected from a nozzle which communicates with the channel. When ink is ejected, the liquid jet head or a recording medium on which a pattern of jetted liquid is to be recorded is moved to render a character or a graphics, or to form a functional thin film in a predetermined shape.

Japanese Patent No. 4658324 describes an ink jet head 100 in which ink channels which are a large number of grooves are formed in a sheet formed of a piezoelectric material. FIG. 16 is a sectional view of the ink jet head 100 illustrated in FIG. 1 of Japanese Patent No. 4658324. The ink jet head 100 has a three-layer structure of a cover 125, a PZT sheet 103 formed of a piezoelectric body, and a bottom cover 137. The cover 125 includes nozzles 127 for ejecting small droplets of ink. In an upper surface of the PZT sheet 103, there are formed ink channels 107 having a cross-section in a boat-like shape. The plurality of ink channels 107 are formed so as to be parallel to each other in a direction orthogonal to a longitudinal direction. Further, the ink channels adjacent to each other are defined by side walls 113. On an upper side-wall surface of each of the side walls 113, there is formed an electrode 115. Also on a side wall surface of the ink channels adjacent to each other, there is formed an electrode. Therefore, each of the side walls 113 is sandwiched between the electrodes (not shown) formed on the side wall surfaces of each of the ink channels adjacent to each other.

The ink channels 107 are communicated to the nozzles 127, respectively. In the PZT sheet 103, there are formed, on a bottom side, a supply duct 132 and a discharge duct 133. The supply duct 132 and the discharge duct 133 are communicated to the ink channel 107 in vicinities of both end portions thereof. The ink is supplied through the supply duct 132, and the ink is discharged through the discharge duct 133. In a surface of the PZT sheet 103 at a right end portion and a left end portion of the ink channel 107, there are formed concave portions 129, respectively. On a bottom surface of each of the concave portions 129, there is formed an electrode (not shown), which is electrically conducted to the electrode 115 formed on the side wall surface of each of the ink channels 107. A connection terminal 134 is received in the concave portion 129. The connection terminal 134 is electrically connected to the electrode formed on the bottom surface of the concave portion 129.

Operation of the ink jet head 100 is as follows. When a drive signal is applied from the connection terminal 134, the drive signal is applied to the electrodes 115 which sandwich the side wall 113. Then, the side wall 113 undergoes thickness shear deformation to change the capacity of the ink channel 107. This causes pressure fluctuations of ink filled into the ink channel 107 to eject an ink droplet through the nozzle 127. This kind of an ink jet head is called a side shoot type and through flow type ink jet head. Ink in the ink channel 107 is supplied from the supply duct 132 and is discharged from the discharge duct 133 to be circulated. Therefore, even if air bubbles enter the ink channel, such air bubbles may be discharged in a short time, and maintenance may be performed without using a cap structure and without using a service station.

Japanese Patent No. 4263742 describes an ink jet head having the structure different from that of the above-mentioned inkjet head. FIG. 17 is a partial perspective view of the ink jet head described in Japanese Patent No. 4263742. The ink jet head includes two antechambers 931 and 941 on a lower side which are separated from each other by a partition, two plenum chambers 980' and 980" on an upper side which are separated from the lower side by a base plate 900, trapezoidal PZT blocks 110 which separate the two plenum chambers 980' and 980" from each other and which are formed of a piezoelectric body, and a plate 991 which closes upper portions of the PZT blocks 110 and which has a plurality of nozzles 994 formed therein. An inlet manifold 930 is placed in the antechamber 931. The inlet manifold 930 may supply ink to the plenum chamber 980' via ports 972 formed in the base plate 900. An outlet manifold 940 is placed in the antechamber 941 and discharges ink via ports formed in the base plate 900. Ink which flows into the plenum chamber 980' flows via spaces between the trapezoidal PZT blocks 110 to the plenum chamber 980".

A drive electrode is formed on each side surface of each of the PZT blocks 110. Two extracting electrodes which are connected to the drive electrodes and which are electrically separated from each other are formed on an upper surface and an inclined surface of each of the PZT blocks 110 (see FIG. 7 of Japanese Patent No. 4658324). A large number of conductive tracks are formed on an upper surface of the base plate 900 to be electrically connected to the above-mentioned extracting electrodes (see FIGS. 14 and 15 of Japanese Patent No. 4658324). By applying a drive signal via the conductive tracks and the extracting electrodes to the drive electrodes, the PZT blocks 110 undergo shear deformation and a pressure wave is produced in ink filled into a chamber between the PZT blocks 110 to eject ink through the corresponding nozzle 994.

In recent years, downsizing of an ink jet head is required. However, downsizing of the ink jet head described in Japanese Patent No. 4658324 has a ceiling. In the ink jet head 100 of Japanese Patent No. 4658324, the ink channel 107 is in the shape of a boat which is convex on a bottom side. This is because a disc-like dicing blade (also referred to as a diamond wheel) is used when grooves as the ink channels 107 are formed in the front surface of the PZT sheet 103, and the shape of the ends of the grooves reflects the outside shape of the dicing blade. For example, when a dicing blade having a diameter of 4 inches is used to form the ink channels 107 having a depth of 350 μm, the length on the PZT sheet 103 to which the circular shape of the dicing blade is transferred is about 12 mm in total. This means that, when the ink channels 107 are formed, in addition to the channel length of the ink channels 107, dead spaces having an arc-shaped bottom and having lengths of about 12 mm in total need to be secured at both ends thereof. Even if a dicing blade having a diameter of 2 inches is used, dead spaces having lengths of about 8.3 mm in total are necessary at both ends of the ink channels 107. Therefore, the ink jet head 100 cannot be downsized, and in addition, the number of the PZT sheets 103 obtained by dividing a PZT substrate is small, which increases the cost.

The ink jet head described in Japanese Patent No. 4263742 is formed by laminating on the base plate 900 the PZT blocks 110 which form the ink channels. Therefore, it is not necessary to secure dead spaces for forming the ink channels as in the ink jet head described in Japanese Patent No. 4658324. However, in the ink jet head described in Japanese Patent No. 4263742, it is necessary to form a large number of conductive tracks which are electrically separated from one another on the upper surfaces and the inclined surfaces of the PZT blocks 110 and on the upper surface of the base plate 900, and the patterning of the electrodes is complicated and processing takes a long time.

More specifically, there is a height difference of, for example, about 300 μm or more between the upper surfaces of the trapezoidal PZT blocks 110 and the upper surface of the base plate 900. Therefore, it is difficult to collectively pattern a conductive layer deposited on the surfaces thereof by photolithography or etching and to separate the individual electrodes. Therefore, the electrodes are patterned by a method in which a laser is applied to the conductive layer deposited on the upper surfaces and the inclined surfaces of the PZT blocks 110 to locally vaporize the conductor to be removed. However, the number of the electrodes to be formed is several hundreds or more, and thus, it takes a very long time to pattern the electrodes.

Further, in Japanese Patent No. 4658324, the shape of both ends of the ink channels 107 reflects the outside shape of the dicing blade and a stagnation region, in which the flow of ink stagnates, is formed between the ink channels 107 and the supply duct 132 or the discharge duct 133 formed thereunder. Similarly, in the antechamber 931 of the ink jet head of Japanese Patent No. 4263742, ink which flows from the inlet manifold 930 flows to the ports 972, but the inlet manifold 930 is formed of a porous material, and thus, ink fills the antechamber 931. Therefore, a stagnation region, in which the flow of ink stagnates, is formed in a corner of a bottom surface or an upper surface of the antechamber 931, and air bubbles or foreign matter which enters ink remains in the flow path, which is a cause of ejection failure of the nozzles 994.

SUMMARY OF THE INVENTION

The present invention has been made in view of the above-mentioned problems with conventional methods, and an object of the present invention is to provide a liquid jet head which may eliminate the above-mentioned dead spaces so that the liquid jet head can be downsized and which may facilitate patterning of electrodes.

A liquid jet head according to an exemplary embodiment of the present invention includes: a nozzle plate including nozzles for ejecting liquid; side walls placed above the nozzle plate, the side walls forming grooves having a fixed depth in a longitudinal direction thereof; drive electrodes formed on wall surfaces of the side walls; a cover plate placed on upper surfaces of the side walls, the cover plate including: a supply port for supplying liquid to the grooves; and a discharge port for discharging liquid from the grooves; and sealing materials for closing the grooves outside communicating portions between the grooves and the supply port and between the grooves and the discharge port.

Further, the cover plate is placed on the upper surfaces of the side walls under a state in which upper surface ends in the longitudinal direction of the side walls are exposed. The liquid jet head further includes extracting electrodes formed on the upper surface ends, the extracting electrodes being electrically connected to the drive electrodes.

Further, the liquid jet head further includes a flexible substrate having a pattern of wiring electrodes formed on a surface thereof. The flexible substrate is bonded to the upper surface ends and the wiring electrodes are electrically connected to the extracting electrodes.

Further, the grooves include: ejection grooves for ejecting liquid; and dummy grooves which avoid ejecting liquid. The supply port and the discharge port communicate with the ejection grooves. The ejection grooves and the dummy grooves are placed alternately so as to be in parallel with one another.

Further, the supply port and the discharge port are open to the ejection grooves and are closed to the dummy grooves.

Further, the liquid jet head further includes a reinforcing plate placed between the nozzle plate and the side walls, the reinforcing plate including through holes communicating with the nozzles, respectively.

Further, the side walls have a laminated structure of laminated piezoelectric bodies which are polarized in directions opposite to each other.

Further, the cover plate is placed on the upper surfaces of the side walls under a state in which upper surface ends in the longitudinal direction of the side walls are exposed. The liquid jet head further includes extracting electrodes formed on the upper surface ends, the extracting electrodes being electrically connected to the drive electrodes. The grooves include: ejection grooves for ejecting liquid; and dummy grooves which avoid ejecting liquid. The supply port and the discharge port communicate with the ejection grooves. The ejection grooves and the dummy grooves are placed alternately so as to be in parallel with one another. The extracting electrodes include: common extracting electrodes electrically connected to the drive electrodes formed on the wall surfaces on the ejection groove side of the side walls forming the ejection grooves; and individual extracting electrodes electrically connected to the drive electrodes formed on the wall surfaces on the dummy groove side of the side walls. The individual extracting electrodes are placed on an end side of the upper surface ends of the side walls and the common extracting electrodes are placed on the cover plate side of the upper surface ends of the side walls.

Further, the drive electrodes extend to ends in the longitudinal direction of the side walls. Upper ends of the drive electrodes formed on the wall surfaces on the ejection groove side are formed to be lower than the upper surface ends in a depth direction of the grooves on the end side of the side walls. Upper ends of the drive electrodes formed on the wall surfaces on the dummy groove side are formed to be lower than the upper surface ends in the depth direction of the grooves on the cover plate side with respect to the ends of the side walls.

Further, edges formed by the wall surfaces on the ejection groove side of the side walls and the upper surface ends are beveled on the end side of the side walls. Edges formed by the wall surfaces on the dummy groove side of the side walls and the upper surface ends are beveled on the cover plate side with respect to the ends of the side walls.

Further, the liquid jet head further includes a flexible substrate including: a common wiring electrode formed on an edge side of the flexible substrate; and individual wiring electrodes formed on an inner side of the common wiring electrode. The flexible substrate is bonded to the upper surface ends so that the common wiring electrode is electrically connected to the common extracting electrodes and the individual wiring electrodes are electrically connected to the individual extracting electrodes.

A liquid jet apparatus according to another exemplary embodiment of the present invention includes: the liquid jet head according to the exemplary embodiment of the present invention; a moving mechanism for reciprocating the liquid jet head; a liquid supply tube for supplying liquid to the liquid jet head; and a liquid tank for supplying the liquid to the liquid supply tube.

A method of manufacturing a liquid jet head according to a further exemplary embodiment of the present invention includes: forming grooves which are formed by side walls in a front surface of a substrate, the substrate including a piezoelectric material; forming a conductive film by depositing a conductor on the substrate; forming an electrode by patterning the conductive film; bonding a cover plate on the front surface of the substrate; grinding a rear surface which is opposite to the front surface of the substrate to cause the grooves to open to the rear surface side; and bonding a nozzle plate to the rear surface side of the substrate.

Further, the cover plate includes: a supply port for supplying liquid to the grooves; and a discharge port for discharging liquid from the grooves. The method further includes forming nozzles for ejecting liquid in the nozzle plate at locations between the supply port and the discharge port.

Further, the method further includes placing sealing materials in the grooves outside communicating portions between the grooves and the supply port and between the grooves and the discharge port.

Further, the method further includes bonding a reinforcing plate on the rear surface side of the substrate, in which the bonding a reinforcing plate succeeds the grinding a rear surface.

Further, the forming an electrode includes: forming a pattern formed of a resin film on the front surface of the substrate, in which the forming a pattern precedes the forming a conductive film; and forming the electrode by lift-off for removing the resin film, in which the forming the electrode by lift-off succeeds the forming a conductive film.

Further, the forming an electrode includes: forming drive electrodes on wall surfaces of the side walls; and forming extracting electrodes on upper surface ends in a longitudinal direction of the side walls, the extracting electrodes being electrically connected to the drive electrodes.

Further, the method further includes bonding, to the upper surface ends, a flexible substrate having wiring electrodes formed on a surface thereof to electrically connect the wiring electrodes to the extracting electrodes.

Further, the forming grooves includes alternately forming ejection grooves for ejecting liquid and dummy grooves which avoid ejecting liquid so as to be in parallel with one another. The extracting electrodes include: common extracting electrodes electrically connected to the drive electrodes formed in the ejection grooves; and individual extracting electrodes electrically connected to the drive electrodes formed in the dummy grooves. The forming an electrode includes: forming the individual extracting electrodes on an end side of the upper surface ends of the side walls forming the ejection grooves; and forming the common extracting electrodes on an inner side of the individual extracting electrodes of the upper surface ends.

Further, the method further includes beveling edges on the end side formed by wall surfaces and upper surfaces of the side walls forming the ejection grooves and edges on an inner side of the edges on the end side, which are formed by wall surfaces and upper surfaces of the side walls forming the dummy grooves.

The liquid jet head according to the exemplary embodiment of the present invention includes: a nozzle plate including nozzles for ejecting liquid; side walls placed above the nozzle plate, the side walls forming grooves having a fixed depth in a longitudinal direction thereof; drive electrodes formed on wall surfaces of the side walls; a cover plate placed on upper surfaces of the side walls, the cover plate including: a supply port for supplying liquid to the grooves; and a discharge port for discharging liquid from the grooves; and sealing materials for closing the grooves outside communicating portions between the grooves and the supply port and between the grooves and the discharge port. In this way, the outside shape of the dicing blade in forming the grooves is not reflected, and the width in the longitudinal direction of the grooves in the liquid jet head may be set small. Further, it is not necessary to form an electrode pattern on surfaces having a height difference, which facilitates manufacture of the liquid jet head.

DETAILED DESCRIPTION OF THE PREFERRED EMBODIMENTS

Liquid Jet Head

First Embodiment

Figure 1:
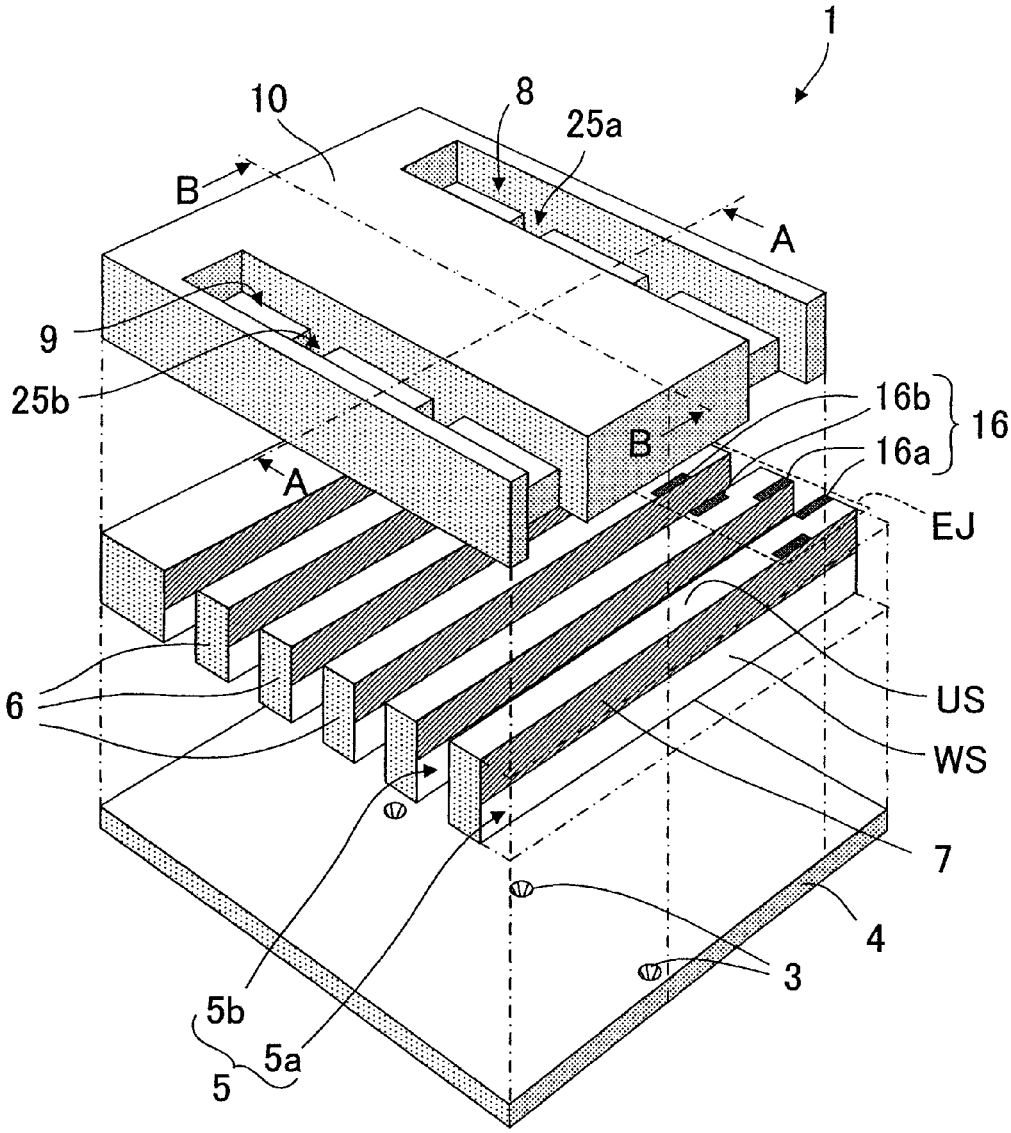
FIG. 1 is a schematic exploded perspective view of a liquid jet head according to a first embodiment of the present invention.
Figure 2:
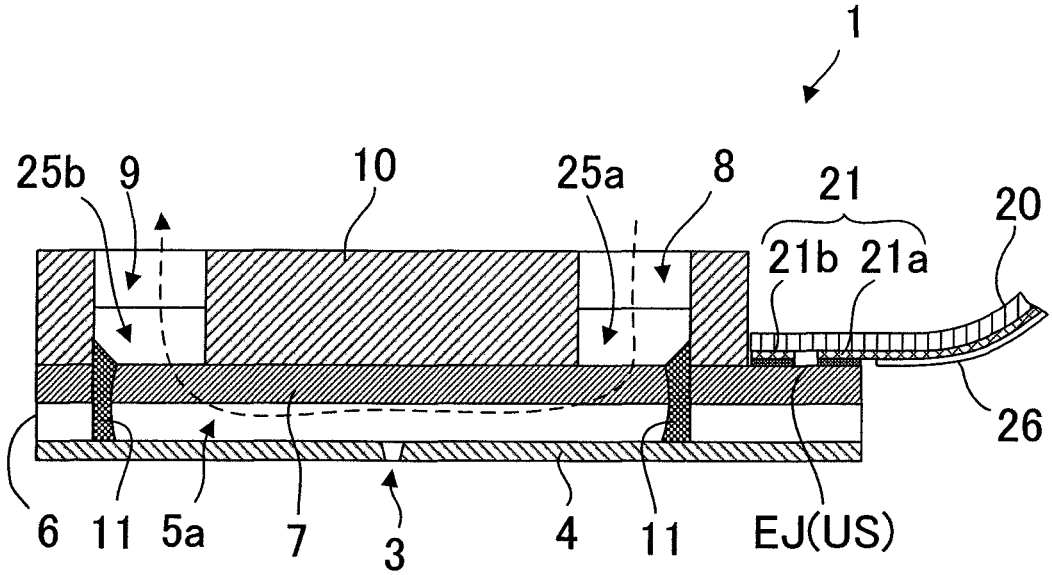
FIG. 2 is a schematic vertical sectional view of the liquid jet head taken along the line A-A of FIG. 1 according to the first embodiment of the present invention.
Figure 3:
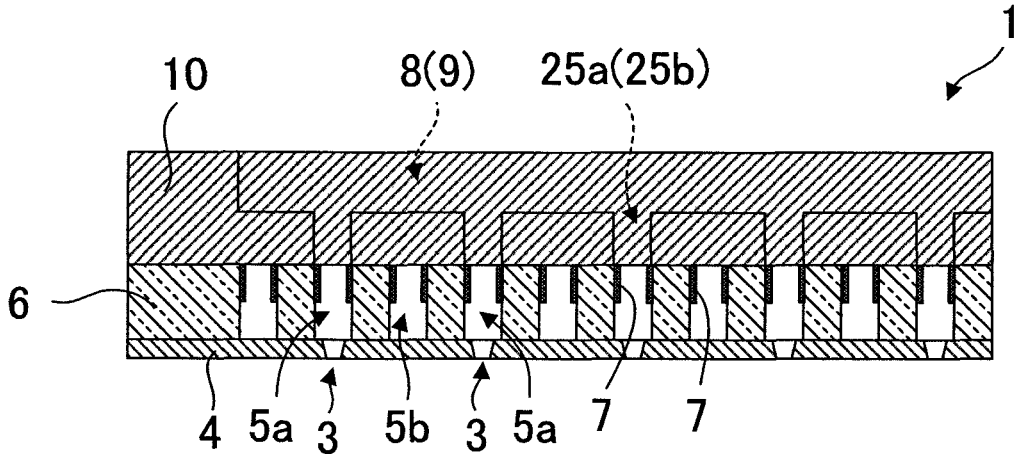
FIG. 3 is a schematic vertical sectional view of the liquid jet head taken along the line B-B of FIG. 1 according to the first embodiment of the present invention.

FIG. 1 is a schematic exploded perspective view of a liquid jet head according to a first embodiment of the present invention. FIG. 2 is a schematic vertical sectional view taken along the line A-A of FIG. 1. FIG. 3 is a schematic vertical sectional view taken along the line B-B of FIG. 1. Note that, in FIG. 2, a flexible substrate 20 bonded to upper surface ends EJ of side walls 6 is additionally illustrated. Further, the line A-A of FIG. 1 is located above slits 25*a* and 25*b* to be described later.

A liquid jet head 1 has a laminated structure in which a nozzle plate 4, a plurality of side walls 6 placed in parallel with one another, and a cover plate 10 are laminated. The nozzle plate 4 includes nozzles 3 for ejecting liquid therethrough. The plurality of side walls 6 are placed above the nozzle plate 4 and form a plurality of grooves 5 having a fixed depth in a longitudinal direction thereof. Each of the side walls 6 is entirely or partially formed of piezoelectric ceramic which is formed of a piezoelectric material, for example, lead zirconate titanate (PZT). The piezoelectric ceramic is polarized, for example, in a vertical direction. A drive electrode 7 for applying an electric field to the piezoelectric material of the side wall 6 to selectively deform the side wall 6 is formed on a wall surface WS of each of the side walls 6. The cover plate 10 is placed on upper surfaces US of the plurality of side walls 6, and includes a supply port 8 for supplying liquid to the plurality of grooves 5 and a discharge port 9 for discharging liquid from the grooves 5. The cover plate 10 is placed on the upper surfaces US of the side walls 6 under a state in which the upper surface ends EJ in the longitudinal direction of the plurality of side walls 6 are exposed.

The plurality of grooves 5 include ejection grooves 5*a* into which liquid is filled and dummy grooves 5*b* into which liquid is not filled. The ejection grooves 5*a* and the dummy grooves 5*b* are alternately arranged. The slits 25*a* and 25*b* are formed in the supply port 8 and the discharge port 9, respectively. The supply port 8 and the ejection grooves 5*a* communicate with each other via the slits 25*a* while the ejection grooves 5*a* and the discharge port 9 communicate with each other via the slits 25*b*. The supply port 8 and the discharge port 9 are closed to the dummy grooves 5*b*. Further, sealing materials 11 are placed for sealing the ejection grooves 5*a* outside communicating portions between the ejection grooves 5*a* and the supply port 8 and between the ejection grooves 5*a* and the discharge port 9, respectively. Therefore, liquid supplied to the supply port 8 is supplied via the slits 25*a* to the ejection grooves 5*a*, and further, is discharged via the slits 25*b* to the discharge port 9, and does not leak to the outside. On the other hand, the dummy grooves 5*b* are closed to the supply port 8 and the discharge port 9, and thus, liquid is not filled into the dummy grooves 5*b*. The nozzles 3 are located substantially in the middle between the supply port 8 and the discharge port 9, and communicate with the ejection grooves 5*a*, respectively. It does not matter whether or not additional nozzles 3 are formed correspondingly to the dummy grooves 5*b*. In this embodiment, in order to reduce the number of process steps, the nozzles 3 are not formed correspondingly to the dummy grooves 5*b*.

The drive electrode 7 is located at an upper half of the wall surface WS of the side wall 6 and is provided so as to extend to ends in the longitudinal direction of the side wall 6. Extracting electrodes 16 are formed on the upper surface end EJ of each of the side walls 6. The extracting electrodes 16 include common extracting electrodes 16*b* electrically connected to the drive electrodes 7 formed on the wall surfaces WS on the ejection groove 5*a* side of the side walls 6 forming the ejection grooves 5*a*, and individual extracting electrodes 16*a* electrically connected to the drive electrodes 7 formed on the wall surfaces WS on the dummy groove 5*b* side of the side walls 6. The individual extracting electrodes 16*a* are placed on an end side of the upper surface ends EJ of the side walls 6, while the common extracting electrodes 16*b* are placed on the cover plate 10 side of the upper surface ends EJ of the side walls 6.

As illustrated in FIG. 2, the flexible substrate 20 is bonded to the upper surface ends EJ of the side walls 6. Wiring electrodes 21 are formed on a lower surface of the flexible substrate 20 and are connected to a drive circuit (not shown). The wiring electrodes 21 include a common wiring electrode 21*b* electrically connected to the common extracting electrodes 16*b* and individual wiring electrodes 21*a* electrically connected to corresponding individual extracting electrodes 16*a*. A protective film 26 is formed on a surface of the wiring electrodes 21 on the flexible substrate 20 except for bonded surfaces thereof to prevent occurrence of a short circuit and the like.

Operation of the liquid jet head 1 is as follows. Liquid such as ink is supplied from a liquid tank or the like (not shown) to the supply port 8. The supplied liquid flows via the slits 25*a* into the ejection grooves 5*a* and flows via the slits 25*b* out to the discharge port 9 to be discharged to the liquid tank or the like (not shown). A drive signal is applied to the individual wiring electrode 21*a* and the common wiring electrode 21*b*. When there is a potential difference between one drive electrode 7 and the other drive electrode 7 which sandwich the side wall 6, the side wall 6 undergoes thickness shear deformation so that the capacity of the ejection groove 5*a* is instantaneously changed and pressure is applied to liquid which is filled thereinto, with the result that a liquid droplet is ejected through a corresponding nozzle 3. For example, in a pull-ejection method, the capacity of the ejection groove 5*a* is once increased to pull liquid thereinto from the supply port 8, and then the capacity of the ejection groove 5*a* is decreased to eject liquid through the nozzle 3. The liquid jet head 1 and a recording medium therebelow are moved to render an image on the recording medium with liquid droplets for recording.

According to the present invention, the depth in the longitudinal direction of the grooves 5 formed between the side walls 6, respectively, is fixed, and the ejection grooves 5*a* outside the communicating portions with the supply port 8 and with the discharge port 9 are closed by the sealing materials 11, respectively. As illustrated in FIG. 2, the sealing materials 11 are formed so as to close the ejection grooves 5*a* and to reach the slits 25*a* and 25*b*, respectively. As a result, the outside shape of the dicing blade used in forming the grooves 5 by grinding may be prevented from being reflected on the piezoelectric body or the substrate to cause dead spaces, and the width in the longitudinal direction of the grooves 5 in the liquid jet head 1 may be significantly reduced. For example, when the depth of the grooves 5 is 350 μm, the width of the liquid jet head 1 may be reduced by 8 mm to 12 mm compared with a case of a conventional method, and the number of sheets obtained from a piezoelectric substrate of the same size becomes larger, which reduces the cost.

Further, the sealing materials 11 are formed inside the slits 25*a* and 25*b* so as to reach the wall surfaces of the slits 25*a* and 25*b*, respectively, and the sealing materials 11 are inclined with respect to the wall surfaces of the slits 25*a* and 25*b*. As a result, stagnation regions of liquid may be reduced. More specifically, the stagnation regions in which liquid stagnates and air bubbles and foreign matter in liquid remain for a long time are small in the ejection grooves 5*a*, the supply port 8, and the discharge port 9. For example, in the conventionally known ink jet head illustrated in FIG. 16, stagnation regions are formed at both ends of the ink channel 107, and air bubbles and foreign matter are liable to stagnate in the ink channel 107. When air bubbles enter the ink channel 107, a pressure wave for ejecting liquid is absorbed in the air bubbles, and a liquid droplet cannot be properly ejected through the nozzle. When such failure is caused, it is necessary to promptly discharge the air bubbles from within the channel. According to the present invention, such stagnation regions are small, and thus, compared with a case of a conventional method, these air bubbles may be promptly discharged.

Figure 16:
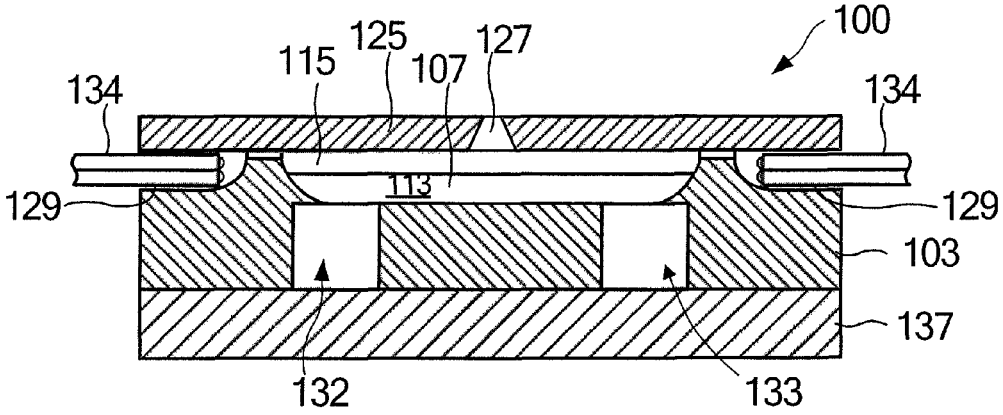
FIG. 16 is a sectional view of a conventionally known ink jet head.
Figure 17:
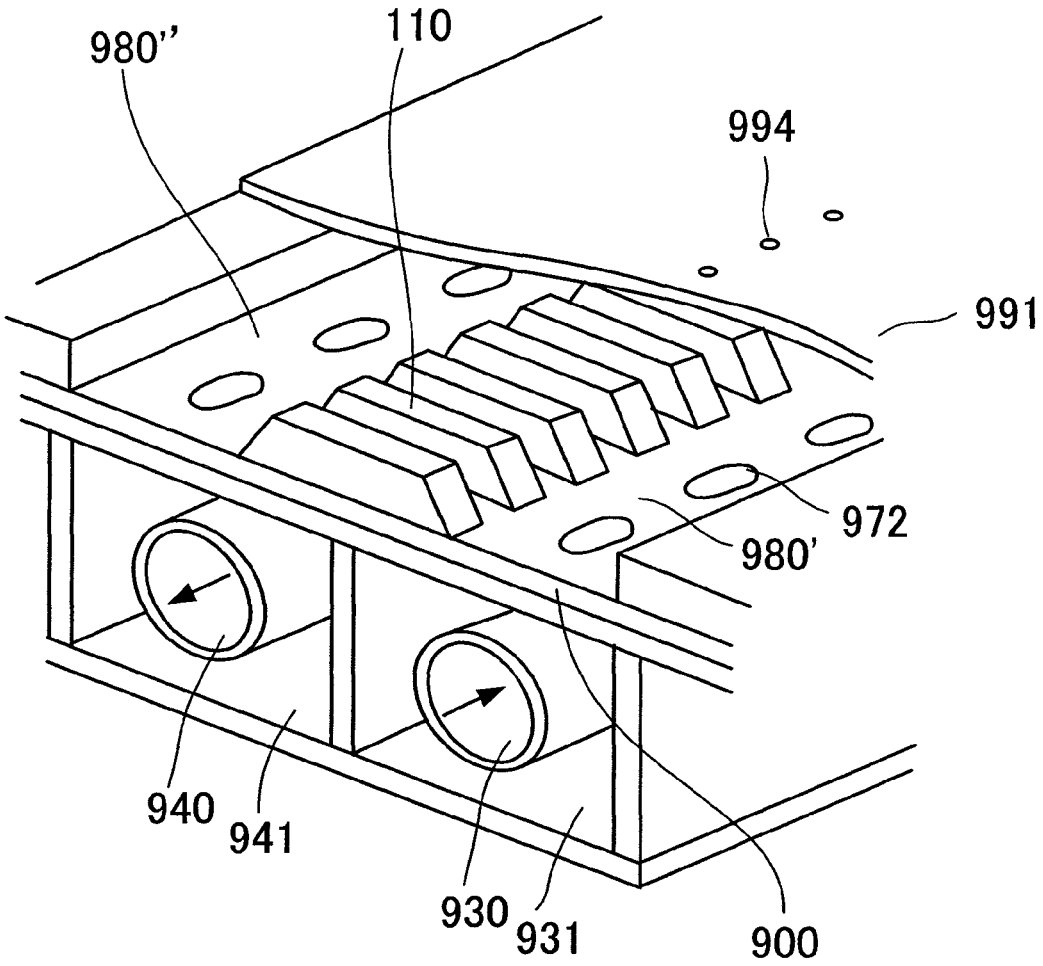
FIG. 17 is a partial perspective view of another conventionally known ink jet head.

Further, in the conventional case illustrated in FIG. 16, it is necessary to form the concave portions 129 in the PZT sheet 103 for preventing the connection terminals 134 and the connecting portions thereof from extending off an ink ejection surface. In the conventional case illustrated in FIG. 17, it is necessary to form on the base plate 900 a connecting portion with a drive circuit and the like, and the formed connecting portion is required to be lower than the surface of the plate 991. On the other hand, according to this embodiment, the flexible substrate 20 is bonded to the upper surface ends EJ which are a part of the upper surfaces US of the side walls 6, and the nozzle plate 4 is bonded to the opposite side of the side walls 6 so that liquid is ejected to the side opposite to the side on which the flexible substrate 20 is bonded. As a result, there is no limitation on the height of the bonded portion of the flexible substrate 20, and not only the flexible substrate 20 may be easily bonded to the upper surfaces US of the side walls 6 but also the design flexibility increases.

Further, in this embodiment, the ejection grooves 5*a* and the dummy grooves 5*b* are alternately arranged so as to be in parallel with one another. Liquid is filled into the ejection grooves 5*a*, while liquid is not filled into the dummy grooves 5*b*. In driving, all the drive electrodes 7 on the ejection groove 5*a* side are connected to a GND in common and a drive signal is selectively applied to the drive electrodes 7 on the dummy groove 5*b* side. This may prevent leakage of a drive signal via liquid even if the liquid which is used is conductive, and recording quality deterioration may be prevented.

Note that, as the cover plate 10, a plastic, ceramic, or the like may be used, but when the same material as that of the side walls 6, for example, PZT ceramic, is used, the thermal expansion coefficient of the cover plate 10 is equal to that of the side walls 6, which enables improvement in durability to withstand thermal change. As the nozzle plate 4, a plastic material, a metal material, ceramic, or the like may be used. When a polyimide material is used as the nozzle plate 4, laser drilling to form the nozzles 3 is facilitated.

Further, in this embodiment, the sealing materials 11 are placed in the ejection grooves 5*a* on the supply port 8 side and on the discharge port 9 side, respectively, but the present invention is not limited thereto. The sealing materials 11 may be caused to flow into the ejection grooves 5*a* from both end sides of the cover plate 10 to fill the sealing materials 11 into the ejection grooves 5*a* outside the supply port 8 and the discharge port 9, respectively, in the cover plate 10.

Second Embodiment

Figure 4:
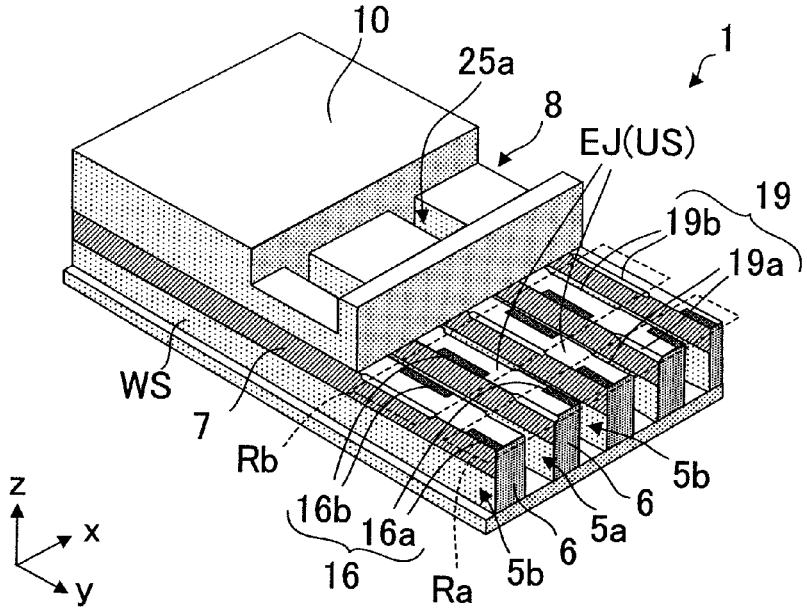
FIG. 4 is a schematic partial perspective view of a liquid jet head according to a second embodiment of the present invention.
Figure 5:
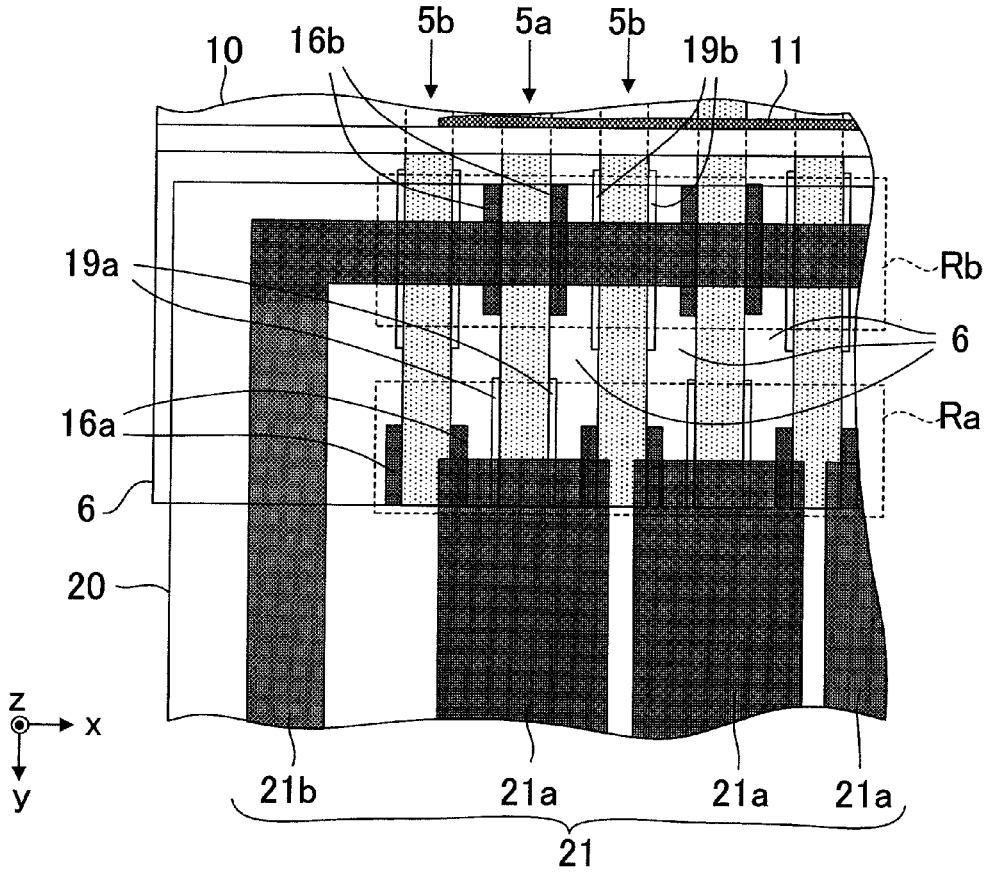
FIG. 5 is a schematic partial plan view illustrating a state of connection between extracting electrodes and wiring electrodes of the liquid jet head according to the second embodiment of the present invention.

FIG. 4 is a schematic partial perspective view illustrating an end of a liquid jet head 1 according to a second embodiment of the present invention. FIG. 5 is a schematic partial plan view illustrating a state of connection between the extracting electrodes 16 formed on the upper surface ends EJ of the side walls 6 and the wiring electrodes 21 formed on the lower surface of the flexible substrate 20.

As illustrated in FIG. 4, the cover plate 10 is placed on the upper surfaces of the plurality of side walls 6 under a state in which the upper surface ends EJ in the longitudinal direction (y direction) of the plurality of side walls 6 are exposed. Here, it is assumed that the end side of the side walls 6 of the upper surface ends EJ is a region Ra and the cover plate 10 side of the upper surface ends EJ is a region Rb. The individual extracting electrodes 16*a* are formed on the end side of the upper surface ends EJ of the side walls 6 forming the dummy grooves 5*b* (in the region Ra) and are electrically connected to the drive electrodes 7 formed on the wall surfaces WS on the dummy groove 5*b* side. The common extracting electrodes 16*b* are formed on the cover plate 10 side of the upper surface ends EJ of the side walls 6 forming the ejection grooves 5*a* (in the region Rb) and are electrically connected to the drive electrodes 7 formed on the wall surfaces WS on the ejection groove 5*a* side.

Further, in the region Ra, edges formed by the wall surfaces WS forming the ejection grooves 5*a* and the upper surface ends EJ are beveled to form bevels 19*a*. Similarly, in the region Rb, edges formed by the wall surface WS forming the dummy grooves 5*b* and the upper surface ends EJ are beveled to form bevels 19*b*. These bevels 19*a* and 19*b* are formed after a conductive film is deposited on the wall surfaces WS. In other words, in the region Ra, the upper ends of the drive electrodes 7 of the ejection grooves 5*a* are formed so as to be deeper in a depth direction of the ejection grooves 5*a* than the upper surface ends EJ. Similarly, in the region Rb, the upper ends of the drive electrodes 7 of the dummy grooves 5*b* are formed so as to be deeper in the depth direction of the dummy grooves 5*b* than the upper surface ends EJ.

On the other hand, the common wiring electrode 21*b* is formed on the surface of the flexible substrate 20 on the extracting electrode 16 side along the edges of the flexible substrate 20, and the plurality of individual wiring electrode 21*a* are formed on the inner side of the common wiring electrode 21*b*. The flexible substrate 20 is bonded to the upper surface ends EJ with an anisotropic conductive material interposed therebetween to electrically connect the common wiring electrode 21*b* to all the common extracting electrodes 16*b* formed in the region Rb and to electrically connect the individual wiring electrodes 21*a* to the individual extracting electrodes 16*a* formed in the region Ra of the side walls 6 sandwiching the ejection grooves 5*a*, respectively.

In the regions Ra and Rb, the upper end of the drive electrode 7 is lower than the upper surface ends EJ, and thus, when the flexible substrate 20 is bonded to the upper surface ends EJ, the common wiring electrode 21*b* on the flexible substrate 20 and the drive electrodes 7 on the wall surfaces WS of the dummy grooves 5*b* are electrically separated from each other. Similarly, the individual wiring electrodes 21*a* on the flexible substrate 20 and the drive electrodes 7 on the wall surfaces WS of the ejection grooves 5*a* are electrically separated from each other. In this way, without forming a recess or the like in the upper surfaces US of the side walls 6, the extracting electrodes 16 (the individual extracting electrodes 16*a* and the common extracting electrodes 16*b*) on the upper surface ends EJ and the wiring electrodes 21 (the individual wiring electrodes 21*a* and the common wiring electrode 21*b*) on the flexible substrate 20 may be electrically connected, respectively. Further, the alignment accuracy when the flexible substrate 20 is bonded to the upper surface ends EJ is relaxed to approximately ½ of the width of the grooves 5.

Note that, in this embodiment, the bevels 19 are formed between the wall surfaces WS and the upper surfaces US of the side walls 6 in the regions Ra and Rb to electrically separate the common wiring electrode 21*b* on the flexible substrate 20 and the drive electrodes 7 on the wall surfaces WS of the dummy grooves 5*b* and to electrically separate the individual wiring electrodes 21*a* on the flexible substrate 20 and the drive electrodes 7 on the wall surfaces WS of the ejection grooves 5*a*, but the present invention is not limited thereto. Instead of forming the bevels 19, the drive electrodes 7 of the portions concerned may be removed by photolithography and etching, or may be removed by applying a laser. Further, instead of removing the drive electrodes 7 of the portions concerned, an insulating layer may be interposed between the upper ends of the drive electrodes 7 and the wiring electrodes 21 on the flexible substrate 20 to achieve the electrical separation.

Third Embodiment

Figure 6A:
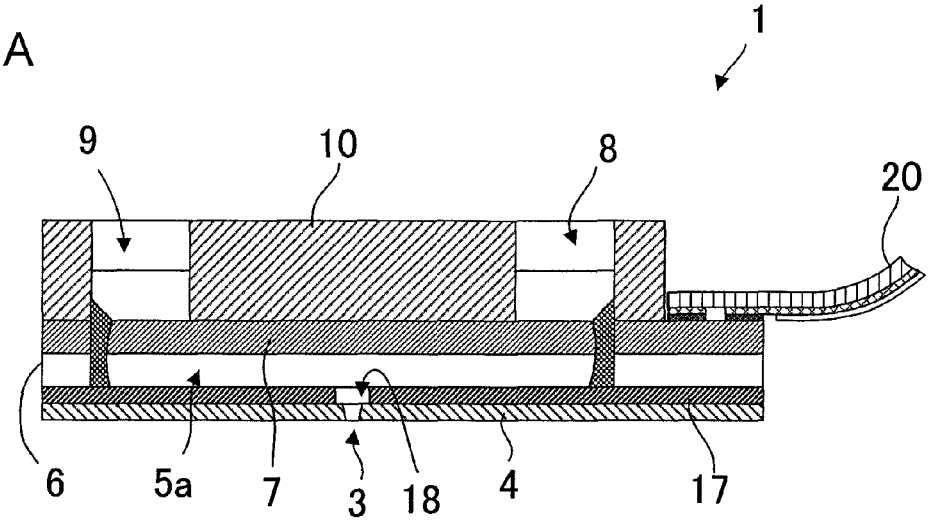
FIGS. 6A and 6B are schematic vertical sectional views of a liquid jet head according to a third embodiment of the present invention.
Figure 6B:
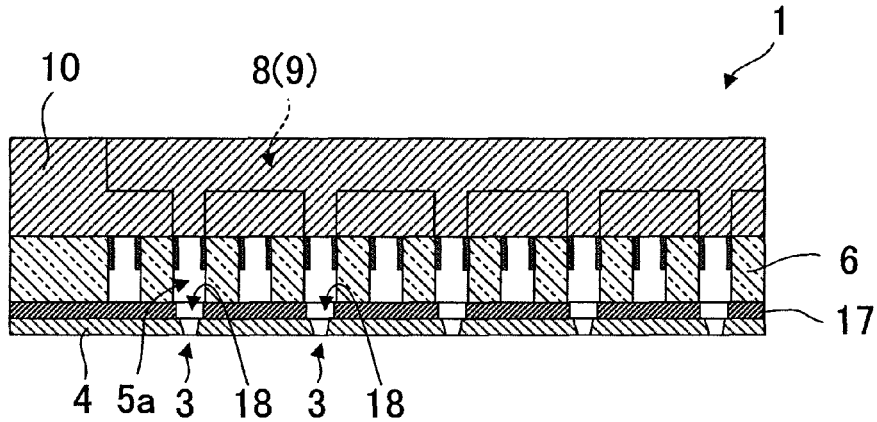

FIGS. 6A and 6B are schematic vertical sectional views of a liquid jet head 1 according to a third embodiment of the present invention. FIG. 6A is a vertical sectional view in the longitudinal direction of the ejection groove 5*a*, while FIG. 6B is a vertical sectional view in a direction orthogonal to the longitudinal direction of the grooves 5. This embodiment is different from the first embodiment in that a reinforcing plate 17 is inserted between the nozzle plate 4 and the side walls 6, and is similar to the first embodiment in other respects. Therefore, in the following, points different from the first embodiment are mainly described and description of other points is omitted. Like reference symbols are used to represent like members or members having like functions.

When a drive signal is applied to the drive electrodes 7 formed on both wall surfaces WS of the side wall 6 to cause the side wall 6 to undergo thickness shear deformation, if a synthetic resin material such as a polyimide film is used as the nozzle plate 4, the nozzle plate 4 expands and contracts, and the upper end of the side wall 6 undergoes displacement, with the result that the conversion efficiency of fluctuations in pressure applied to liquid filled into the grooves 5 is reduced. Therefore, the reinforcing plate 17 having an elastic modulus higher than that of the nozzle plate 4 is placed between the nozzle plate 4 and the side wall 6 and the upper ends of the side walls 6 are fixed to prevent the above-mentioned reduction of the conversion efficiency. Through holes 18 are provided in the reinforcing plate 17 at locations corresponding to the nozzles 3 to enable ejection of liquid droplets.

As the reinforcing plate 17, for example, a metal plate or a ceramic plate having a thickness of 50 μm to 100 μm may be used. As the metal material, Mo, SUS (stainless steel), Ni, Ti, Cr, or the like may be used. As the ceramic material, ceramic formed of an oxide, a nitride, or a carbide of a metal or a semiconductor or machinable ceramic may be used. In particular, it is preferred that a material having a thermal expansion coefficient similar to that of the material of the side walls 6 be used. For example, when PZT is used as the side walls 6, it is preferred that Mo or machinable ceramic having a thermal expansion coefficient similar to that of PZT be used.

Fourth Embodiment

Figure 7:
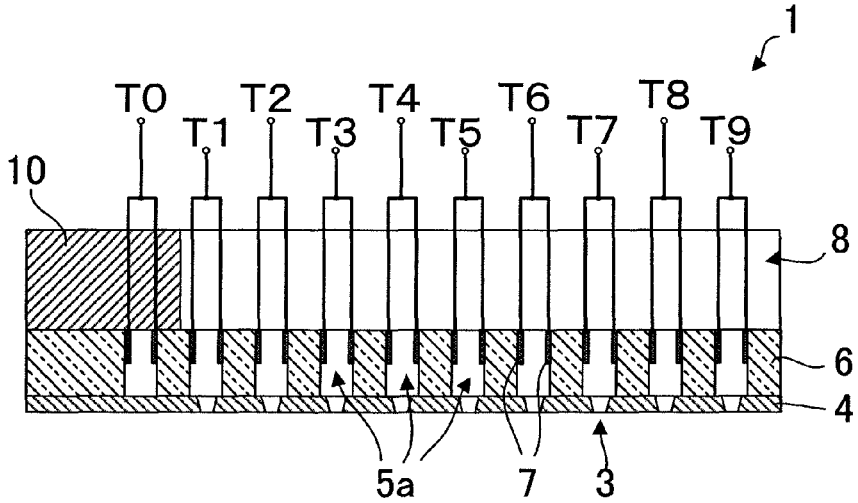
FIG. 7 is an explanatory diagram in which electrode wiring is added to a vertical section taken in a longitudinal direction of a supply port of a liquid jet head according to a fourth embodiment of the present invention.

FIG. 7 illustrates a liquid jet head 1 according to a fourth embodiment of the present invention, and is an explanatory diagram in which electrode wiring is added to a vertical section taken in the longitudinal direction of the supply port 8. This embodiment is different from the first embodiment in that all the grooves 5 except those at both ends are the ejection grooves 5*a*. Accordingly, the supply port 8 and the discharge port (not shown) in the cover plate 10 which is placed above the side walls 6 communicate with all the ejection grooves 5*a*. Further, the nozzle plate 4 placed under the side walls 6 has the nozzles 3 which communicate with the ejection grooves 5*a*, respectively. The nozzles 3 are located substantially in the middle between the supply port and the discharge port in the longitudinal direction of the ejection grooves 5*a*. Terminals T0 to T9 are each electrically connected to the drive electrodes 7 formed on both wall surfaces of corresponding ejection grooves 5*a*.

The liquid jet head 1 ejects liquid droplets in accordance with a three-cycle drive system. More specifically, a drive signal is applied between the terminal T1 and the terminal T0 and between the terminal T1 and the terminal T2 to cause liquid to be ejected from the ejection groove 5*a* corresponding to the terminal T1. Then, a drive signal is applied between the terminal T2 and the terminal T1 and between the terminal T2 and the terminal T3 to cause liquid to be ejected from the ejection groove 5*a* corresponding to the terminal T2. Then, a drive signal is applied between the terminal T3 and the terminal T2 and between the terminal T3 and the terminal T4 to cause liquid to be ejected from the ejection groove 5*a* corresponding to the terminal T3. The process proceeds in the same way. More specifically, three adjacent ejection grooves 5*a* are selected in order repeatedly and liquid is caused to be ejected. This enables higher density recording compared with the case of the liquid jet head 1 according to the first embodiment. Note that, when the reinforcing plate 17 is inserted between the nozzle plate 4 and the side walls 6 similarly to the third embodiment, reduction of the deformation efficiency of the side walls 6 may be prevented.

Fifth Embodiment

Figure 8:
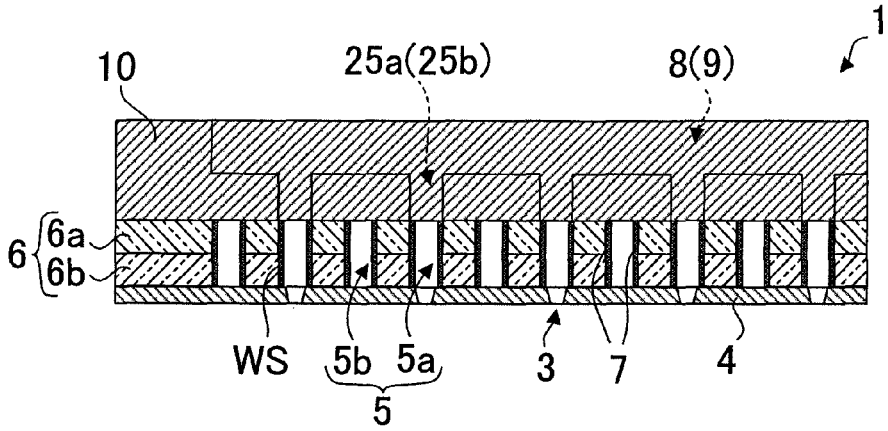
FIG. 8 is a schematic vertical sectional view taken in a longitudinal direction of a supply port of a liquid jet head according to a fifth embodiment of the present invention.

FIG. 8 illustrates a liquid jet head 1 according to a fifth embodiment of the present invention, and is a schematic vertical sectional view taken in a direction orthogonal to the longitudinal direction of the grooves 5. This embodiment is different from the first embodiment in the structure of the side walls 6 and in the drive electrodes 7 formed on the wall surfaces WS thereof, and is similar to the first embodiment in other respects. Therefore, in the following, points different from the first embodiment are mainly described and description of the same points is omitted. Like reference symbols are used to represent like members or members having like functions.

The liquid jet head 1 has a laminated structure of the nozzle plate 4, the side walls 6, and the cover plate 10. The plurality of side walls 6 form the plurality of grooves 5 having a fixed depth in the longitudinal direction thereof, and the plurality of grooves 5 include the ejection grooves 5*a* and the dummy grooves 5*b* which are alternately arranged. The cover plate 10 includes the supply port 8 and the discharge port 9 (not shown), and the supply port 8 and the discharge port 9 communicate with the ejection grooves 5*a* via the slits 25*a* and the slits 25*b* (not shown). The nozzle plate 4 includes the nozzles 3 at locations corresponding to the ejection grooves 5*a*, and the nozzles 3 communicate with the ejection grooves 5*a*, respectively.

Here, the side walls 6 are formed of a piezoelectric body which is polarized, and the direction of the polarization of side walls 6*a* which are located at upper halves of the side walls 6 and the direction of the polarization of side wall 6*b* which are located at lower halves of the side walls 6 are opposite to each other. For example, the side walls 6*a* are upwardly polarized while the side walls 6*b* are downwardly polarized. The drive electrodes 7 are formed from the upper ends to the lower ends of the wall surfaces WS of the side walls 6*a* and of the side walls 6*b*. When both drive electrodes 7 of the ejection groove 5*a* are connected to the GND and a drive signal is applied to two drive electrodes 7 on the ejection groove 5*a* side of two dummy grooves 5*b* adjacent to the ejection groove 5*a*, the side walls 6 are bent with respect to the directions of the polarization and a pressure wave is produced in liquid filled into the ejection groove 5*a* to eject liquid from the corresponding nozzle 3. When the directions of the polarization are set opposite to each other and the same voltage is applied to the side walls 6*a* and the side walls 6*b*, compared with a case in which voltage is applied only to the side walls 6*a* which are located at the upper halves, the amount of deformation of the side walls 6 becomes larger, and thus, when the same amount of deformation is caused, the drive voltage in this embodiment may be set lower than that in the first embodiment.

Note that, the cover plate 10 may be placed on the upper surfaces of the side walls 6 so that the upper surface ends in the longitudinal direction of the side walls 6 are exposed, and, similarly to the second embodiment, the extracting electrodes 16 may be formed on the upper surface ends, and the flexible substrate 20 having the wiring electrodes 21 formed thereon may be bonded to the extracting electrodes 16. Further, similarly to the third embodiment, the reinforcing plate 17 may be placed between the nozzle plate 4 and the plurality of side walls 6 so that deformation of the side walls 6 is prevented from being absorbed by the nozzle plate 4 to reduce the deformation efficiency. Further, similarly to the fourth embodiment, all the grooves 5 may be the ejection grooves 5*a* and liquid droplets may be ejected in accordance with the three-cycle drive system to enable high density recording.

Sixth Embodiment

Figure 9A:
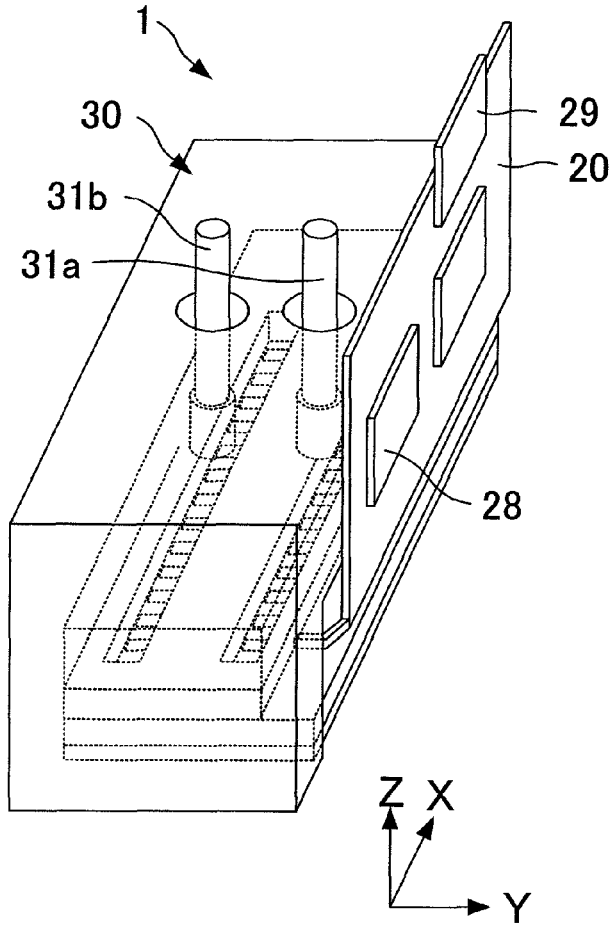
FIGS. 9A and 9B are schematic perspective views of a liquid jet head according to a sixth embodiment of the present invention.
Figure 9B:
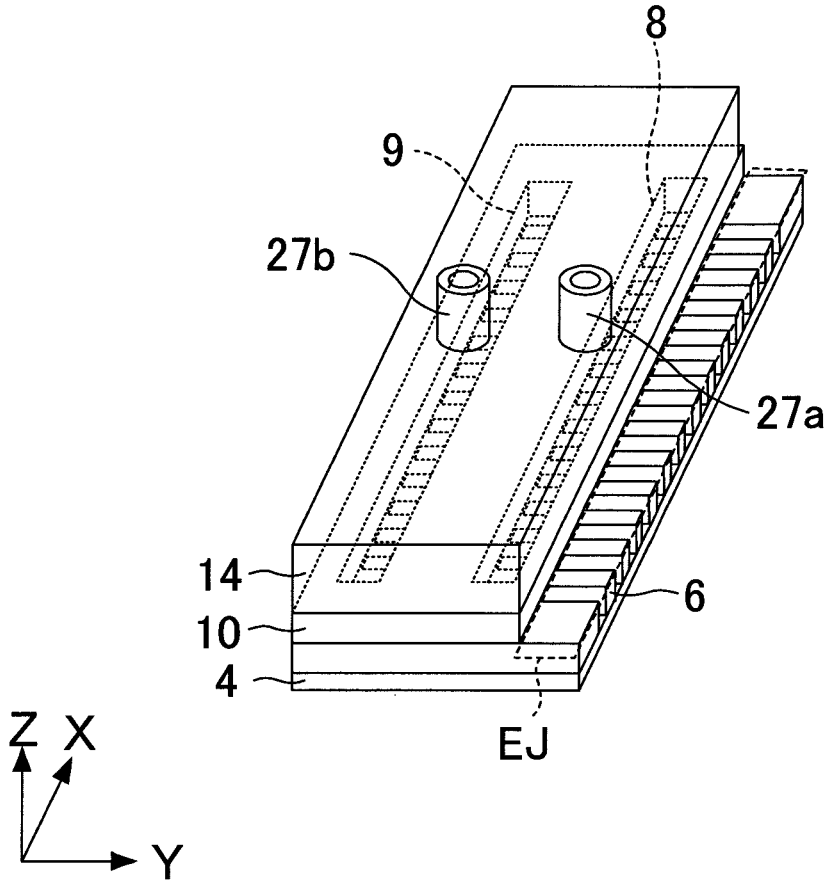

FIGS. 9A and 9B are schematic perspective views of a liquid jet head 1 according to a sixth embodiment of the present invention. FIG. 9A is a perspective view of the entire liquid jet head 1 and FIG. 9B is a perspective view illustrating the inside of the liquid jet head 1.

As illustrated in FIGS. 9A and 9B, the liquid jet head 1 has a laminated structure of the nozzle plate 4, the plurality of side walls 6, the cover plate 10, and a flow path member 14. The laminated structure of the nozzle plate 4, the plurality of side walls 6, and the cover plate 10 is the same as that of any one of the first to fifth embodiments. The width of the nozzle plate 4 and the side walls 6 in the y direction is longer than the width of the cover plate 10 and the flow path member 14 in the y direction, and the cover plate 10 is bonded to the upper surfaces of the side walls 6 so that the upper surface ends EJ on one side of the side walls 6 are exposed. The plurality of side walls 6 are arranged in an x direction, and the plurality of grooves 5 having a fixed depth in the longitudinal direction are formed between adjacent side walls 6, respectively. The cover plate 10 includes the supply port 8 and the discharge port 9 which communicate with the plurality of grooves 5.

The flow path member 14 includes a liquid supply chamber (not shown) and a liquid discharge chamber (not shown) which are concave portions that open to a surface of the flow path member 14 on the cover plate 10 side, and includes, in a surface thereof on the side opposite to the cover plate 10, a supply joint 27*a* which communicates with the liquid supply chamber and a discharge joint 27*b* which communicates with the liquid discharge chamber.

The drive electrodes (not shown) are formed on the wall surfaces of the side walls 6, respectively, and are electrically connected to the extracting electrodes (not shown) which are formed on the upper surface ends EJ of corresponding side walls 6. The flexible substrate 20 is bonded to the upper surface ends EJ. A large number of wiring electrodes are formed on a surface of the flexible substrate 20 on the upper surface end EJ side, and are electrically connected to the extracting electrodes 16 formed on the upper surface ends EJ. The flexible substrate 20 includes, on a surface thereof, a driver IC 28 as a drive circuit and a connector 29. Based on a signal which is input from the connector 29, the driver IC 28 generates a drive signal for driving the side walls 6, and supplies the drive signal via the wiring electrodes and the extracting electrodes to the drive electrodes (not shown).

A base 30 houses a laminated body of the nozzle plate 4, the side walls 6, the cover plate 10, and the flow path member 14. A liquid jetting surface of the nozzle plate 4 is exposed on a lower surface of the base 30. The flexible substrate 20 is drawn to the outside from a side surface of the base 30, and is fixed to an outer side surface of the base 30. An upper surface of the base 30 includes two through holes. A supply tube 31*a* for supplying liquid passes through one of the through holes to be connected to the supply joint 27*a* while a discharge tube 31*b* for discharging liquid passes through the other of the through holes to be connected to the discharge joint 27*b*. Other points in the structure are similar to those of any one of the first to fifth embodiments, and thus, the description thereof is omitted.

The flow path member 14 is provided so that liquid is supplied from above and liquid is discharged to the above, and further, the driver IC 28 is mounted on the flexible substrate 20 and the flexible substrate 20 is bent in a z direction so as to be provided upright. As described above, when the grooves 5 are formed, the outside shape of the dicing blade is prevented from being reflected on ends in the y direction of the grooves 5 to cause dead spaces, and thus, the width in the y direction may be set small, and in addition, the wiring may become compact. Further, the driver IC 28 and the side walls 6 generate heat when driven, and such heat is transferred via the base 30 and the flow path member 14 to liquid which passes therethrough. More specifically, liquid for recording on a recording medium may be utilized as a cooling medium to effectively dissipate to the outside heat generated inside. Therefore, degradation in drive performance due to overheat of the driver IC 28 or the side walls 6 may be prevented. Further, liquid circulates within the ejection grooves, and thus, even if air bubbles enter the ejection groove, such air bubbles may be promptly discharged to the outside. Further, liquid is not wasted, and waste of a recording medium due to recording failure may be suppressed. This enables provision of the reliable liquid jet head 1.

Liquid Jet Apparatus

Seventh Embodiment

Figure 10:
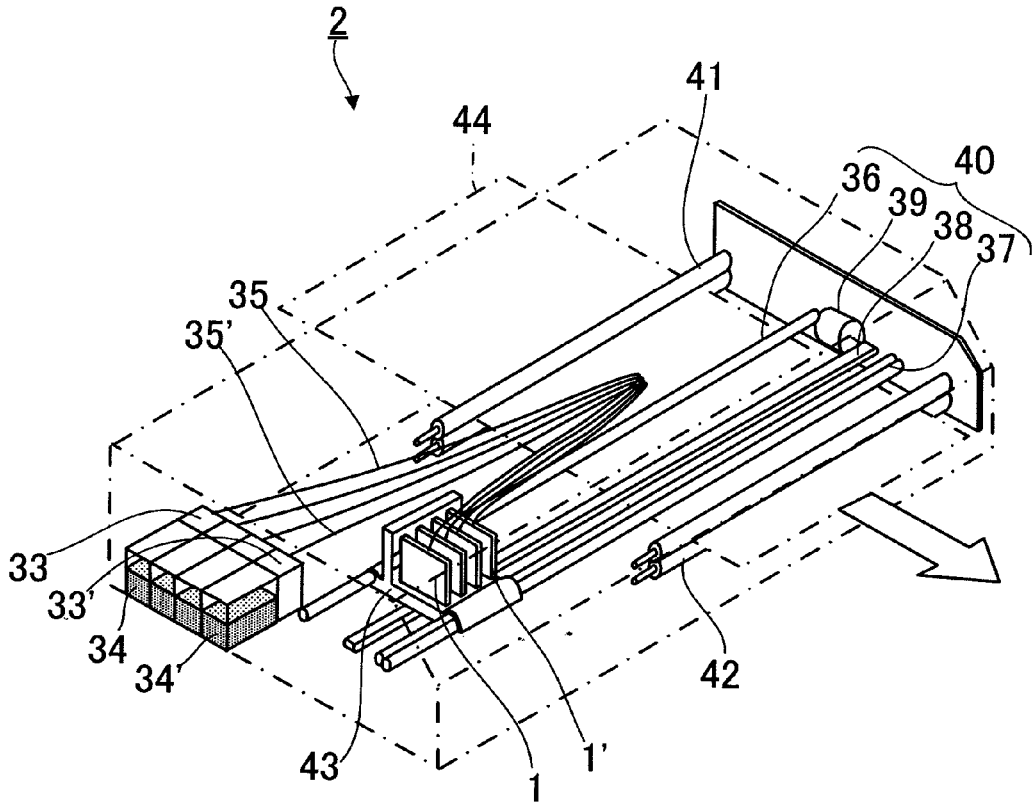
FIG. 10 is a schematic perspective view of a liquid jet apparatus according to a seventh embodiment of the present invention.

FIG. 10 is a schematic perspective view of a liquid jet apparatus 2 according to a seventh embodiment of the present invention. The liquid jet apparatus 2 includes a moving mechanism 40 for reciprocating liquid jet heads 1 and 1', flow path portions 35 and 35' for supplying liquid to the liquid jet heads 1 and 1', and liquid pumps 33 and 33' and liquid tanks 34 and 34' for supplying liquid to the flow path portions 35 and 35'. Each of the liquid jet heads 1 and 1' includes a plurality of ejection grooves, and a liquid droplet is ejected through a nozzle which communicates with each of the ejection grooves. As the liquid jet heads 1 and 1', any ones of the liquid jet heads of the first to sixth embodiments described above is used.

The liquid jet apparatus 2 includes a pair of conveyance means 41 and 42 for conveying a recording medium 44 such as paper in a main scanning direction, the liquid jet heads 1 and 1' for ejecting liquid toward the recording medium 44, a carriage unit 43 for mounting thereon the liquid jet heads 1 and 1', the liquid pumps 33 and 33' for pressurizing liquid stored in the liquid tanks 34 and 34' into the flow path portions 35 and 35' for supply, and the moving mechanism 40 for causing the liquid jet heads 1 and 1' to scan in a sub-scanning direction which is orthogonal to the main scanning direction. A control portion (not shown) controls and drives the liquid jet heads 1 and 1', the moving mechanism 40, and the conveyance means 41 and 42.

Each of the pair of conveyance means 41 and 42 includes a grid roller and a pinch roller which extend in the sub-scanning direction and which rotate with roller surfaces thereof being in contact with each other. A motor (not shown) axially rotates the grid rollers and the pinch rollers to convey in the main scanning direction the recording medium 44 sandwiched therebetween. The moving mechanism 40 includes a pair of guide rails 36 and 37 which extend in the sub-scanning direction, the carriage unit 43 which is slidable along the pair of guide rails 36 and 37, an endless belt 38 which is coupled to the carriage unit 43 for moving the carriage unit 43 in the sub-scanning direction, and a motor 39 for rotating the endless belt 38 via a pulley (not shown).

The carriage unit 43 has the plurality of liquid jet heads 1 and 1' mounted thereon for ejecting, for example, four kinds of liquid droplets: yellow; magenta; cyan; and black. The liquid tanks 34 and 34' store liquid of corresponding colors, and supply the liquid via the liquid pumps 33 and 33' and the flow path portions 35 and 35' to the liquid jet heads 1 and 1'. The respective liquid jet heads 1 and 1' eject liquid droplets of the respective colors in accordance with a drive signal. Through control of ejection timings of liquid from the liquid jet heads 1 and 1', rotation of the motor 39 for driving the carriage unit 43, and conveyance speed of the recording medium 44, an arbitrary pattern may be recorded on the recording medium 44.

(Method of Manufacturing Liquid Jet Head)

Figure 11:
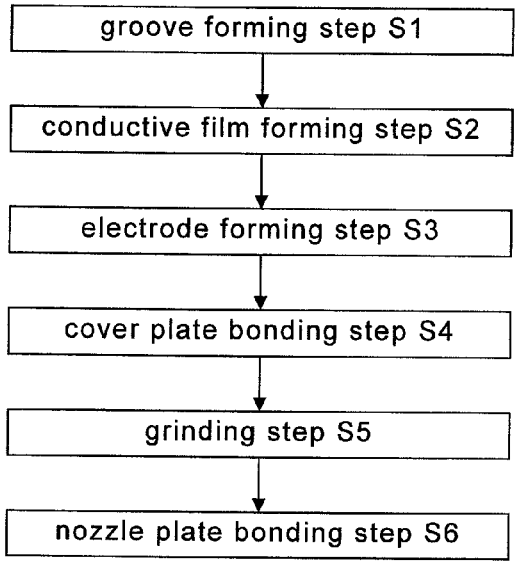
FIG. 11 is a process flow chart illustrating a basic method of manufacturing the liquid jet head according to the present invention.

Next, a method of manufacturing a liquid jet head according to the present invention is described. FIG. 11 is a process flow chart illustrating a basic method of manufacturing the liquid jet head according to the present invention. First, a piezoelectric substrate, a substrate formed by laminating a piezoelectric substrate and an insulating substrate, or a substrate formed by bonding two piezoelectric substrates in which the directions of polarization are opposite to each other is prepared, and a plurality of grooves are formed in a front surface thereof (groove forming step S1). As the piezoelectric substrate, PZT ceramic may be used. Then, a conductor is deposited on the front surface of the substrate having the grooves formed therein (conductive film forming step S2). A metal material is used as the conductor, and vapor deposition, sputtering, plating, or the like is used to deposit and form the conductive film. After that, the conductive film is patterned to form electrodes (electrode forming step S3). With regard to the electrodes, drive electrodes are formed on wall surface of side walls while extracting electrodes are formed on upper surfaces of the side walls. With regard to the patterning, photolithography and etching, lift-off, or laser application is used to locally remove the conductive film and to form an electrode pattern.

Then, a cover plate is bonded to the front surface of the substrate, that is, the upper surfaces of the plurality of side walls (cover plate bonding step S4). In the bonding, an adhesive may be used. A supply port and a discharge port which pass through the cover plate from a front surface to a rear surface of the cover plate and communicate with the plurality of grooves are formed in advance. As the cover plate, the same material as that of the substrate to which the cover plate is bonded, for example, PZT ceramic, may be used. When the thermal expansion coefficient of the substrate and the thermal expansion coefficient of the cover plate are set equal to each other, peeling and a crack may be less liable to occur to improve the durability. Next, the rear surface which is opposite to the front surface of the substrate is ground to cause the plurality of grooves to open to the rear surface side (grinding step S5). When the grooves are caused to open, the side walls which separate the grooves are separated, but the cover plate is bonded to the upper surface side, and thus, the side walls do not fall down to pieces. Then, a nozzle plate is bonded to the rear surface side of the substrate to close the openings of the grooves (nozzle plate bonding step S6).

According to the manufacturing method of the present invention, in the groove forming step S1, the grooves are formed straight in the front surface of the substrate, and thus, the outside shape of a dicing blade is not reflected on the substrate, with the result that the liquid jet head 1 may be downsized. Further, the extracting electrodes for connection to an external circuit are placed on the upper surface of the substrate which is opposite to the nozzle plate side, and thus, connection to the drive circuit is facilitated and it is not necessary to form complicated routing electrodes on the upper surface of the substrate. Further, it is not necessary to pattern electrodes on surfaces having a height difference, and thus, the electrode pattern may be formed in a short time with ease. In the following, the present invention is described in detail based on an embodiment thereof.

Eighth Embodiment

Figure 12:
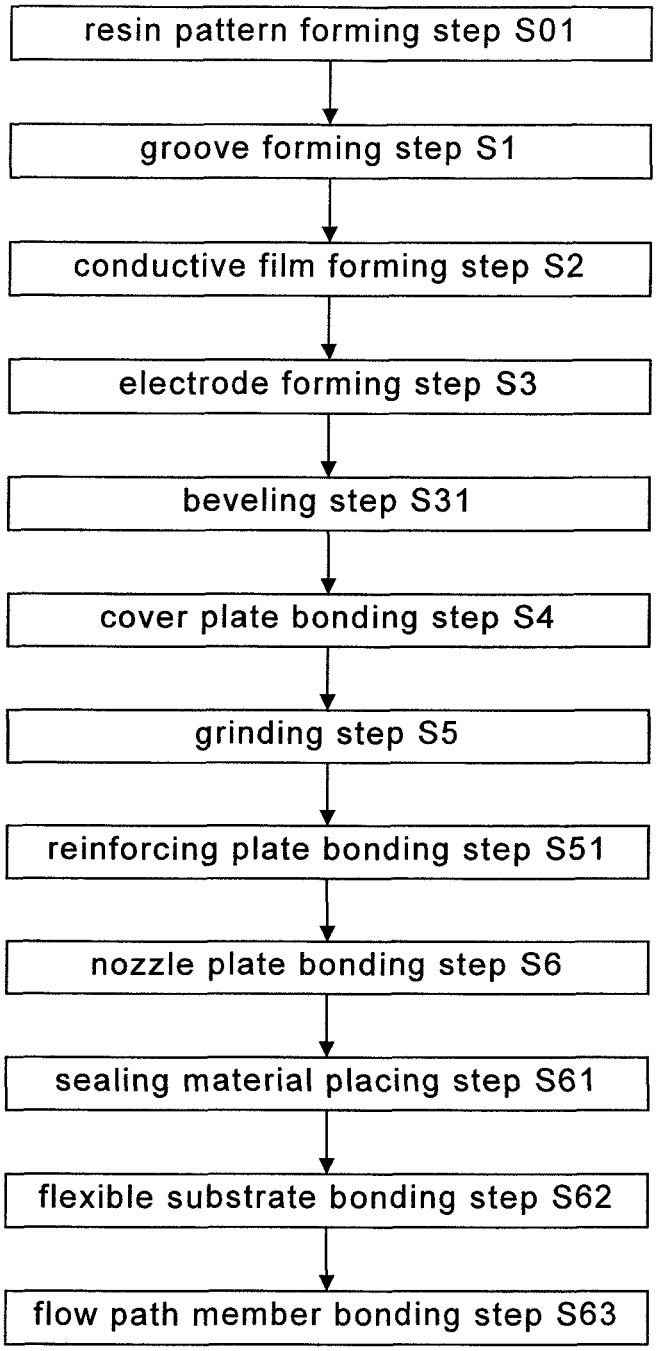
FIG. 12 is a process flow chart illustrating a method of manufacturing a liquid jet head according to an eighth embodiment of the present invention.

FIGS. 12 to 15C illustrate a method of manufacturing a liquid jet head according to an eighth embodiment of the present invention. FIG. 12 is a process flow chart illustrating the method of manufacturing a liquid jet head, and FIGS. 13A to 15C are explanatory diagrams of the respective steps. In this embodiment, there are added, to the basic steps of the groove forming step S1 to the nozzle plate bonding step S6 illustrated in FIG. 11, a resin pattern forming step S01 for forming electrodes by lift-off, a beveling step S31 for preventing a short circuit between the drive electrode 7 and the wiring electrode 21, a reinforcing plate bonding step S51 for improving the conversion efficiency in converting thickness shear deformation of the side wall 6 into pressure applied to liquid, a sealing material placing step S61 for sealing liquid within the ejection grooves 5*a*, a flexible substrate bonding step S62 of bonding the flexible substrate to the upper surface ends EJ, and a flow path member bonding step S63 of bonding the flow path member 14 to the upper surface of the cover plate 10. Like reference symbols are used to represent like members or members having like functions.

Figure 13A:
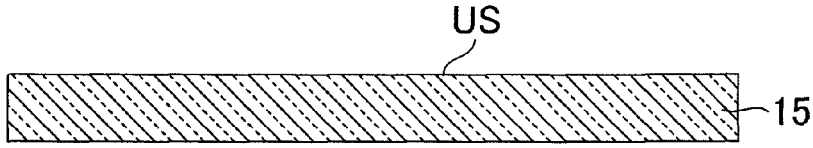
FIGS. 13A to 13G are explanatory diagrams for illustrating the method of manufacturing a liquid jet head according to the eighth embodiment of the present invention.
Figure 13B:
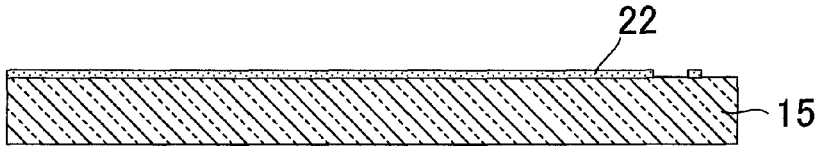

FIG. 13A is a vertical sectional view of a piezoelectric substrate 15. As the piezoelectric substrate 15, PZT ceramic is used, and polarization is carried out in a vertical direction of the substrate. FIG. 13B is an explanatory diagram of the resin pattern forming step S01 in which a photosensitive resin 22 is applied or affixed to the upper surfaces US of the piezoelectric substrate 15 and is patterned. The photosensitive resin 22 is removed from a region in which the conductor for forming the electrodes is left, and the photosensitive resin 22 is left in a region in which the conductor is not left.

Figure 13C:
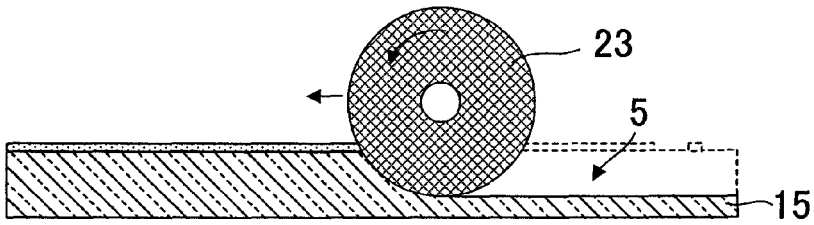
Figure 13D:
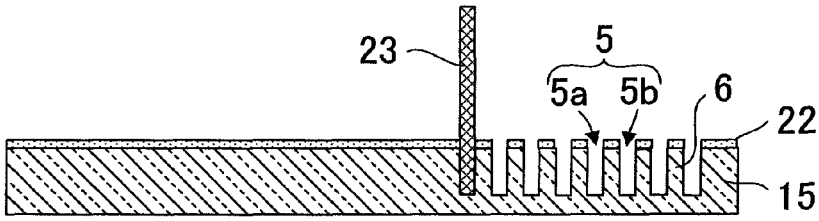
Figure 13E:
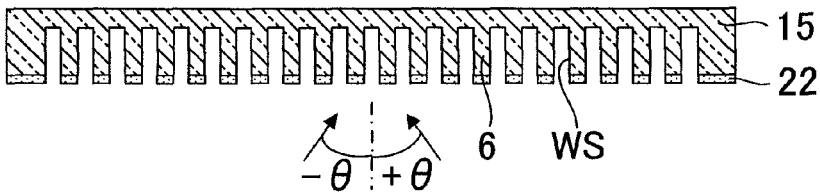

FIGS. 13C and 13D are explanatory diagrams of the groove forming step S1 in which the plurality of grooves 5 are formed in the front surface of the piezoelectric substrate 15 by a dicing blade 23. FIG. 13C is a view seen from a side of the dicing blade 23, while FIG. 13D is a view seen from a direction of movement of the dicing blade 23. The ejection grooves 5*a* and the dummy grooves 5*b* which are alternately arranged so as to be in parallel with one another are formed by grinding with the side wall 6 interposed between the ejection groove 5*a* and the dummy groove 5*b*. The grooves 5 have a fixed depth, for example, a depth of 300 μm to 350 μm, and the width of the ejection grooves 5*a* and the dummy grooves 5*b* is 30 μm to 100 μm.

Figure 13F:
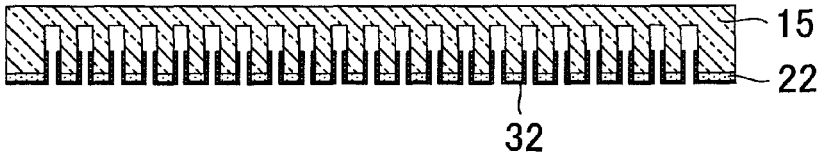

FIGS. 135 and 13F are explanatory diagrams of the conductive film forming step S2 in which a conductor is deposited by oblique deposition on a surface of the piezoelectric substrate 15 to which the grooves 5 are open to form a conductive film 32. The conductor is deposited from directions of an inclination angle (−θ) and an inclination angle (+θ) with respect to the normal to the surface of the piezoelectric substrate 15 which are orthogonal to the longitudinal direction of the grooves 5, thereby depositing the conductor on the upper halves of the wall surfaces and the upper surfaces US of the side walls 6 to form the conductive film 32. As the conductor, a metal such as Al, Mo, Cr, Ag, or Ni may be used. By oblique deposition, the desired conductive film 32 may be formed in the depth direction of the grooves 5, and thus, it is not necessary to pattern the conductive film 32 which is deposited on the wall surfaces WS of the side walls 6.

Figure 13G:
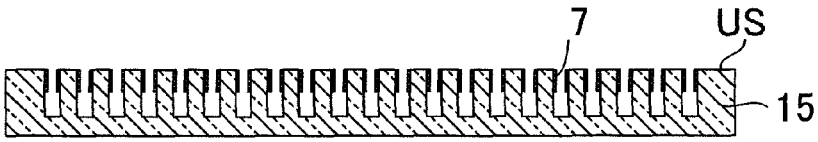

FIG. 13G is an explanatory diagram of the electrode forming step S3 in which the conductive film 32 is patterned by lift-off to form the electrodes. The photosensitive resin 22 and the conductive film 32 on the photosensitive resin 22 are removed from the upper surfaces US of the piezoelectric substrate 15 and the drive electrodes 7 are formed on the wall surfaces WS of the grooves 5 while the extracting electrodes (not shown) are formed on the upper surfaces US of the side walls 6. Note that, the conductive film 32 may be patterned after the conductive film forming step S2 by photolithography and etching or by a laser, but the above-mentioned lift-off may contribute to easier patterning.

Figure 14A:
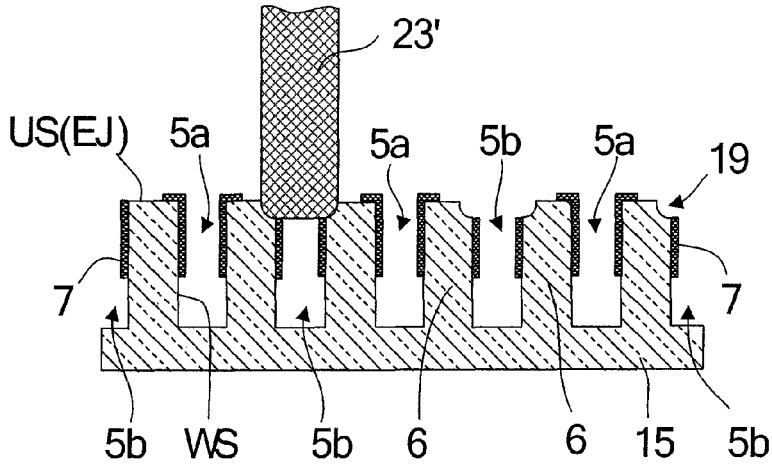
FIGS. 14A to 14E are explanatory diagrams for illustrating the method of manufacturing a liquid jet head according to the eighth embodiment of the present invention.

FIG. 14A is an explanatory diagram of the beveling step S31 in which part of the edges formed by the wall surfaces WS and the upper surfaces US of the side walls 6 is beveled. A dicing blade 23' having a thickness slightly larger than the width of the grooves 5 is used to bevel edges on the end side formed by the wall surfaces WS and the upper surfaces US of the side walls 6 forming the dummy grooves 5*b*, thereby forming the bevels 19. Similarly, edges inside the above-mentioned bevels 19 formed by the wall surfaces WS and the upper surfaces US of the side walls 6 forming the ejection grooves 5*a* are beveled to form bevels. Upper ends of the drive electrodes 7 formed on the wall surfaces WS are ground to set the upper ends of the drive electrodes 7 to be lower than the upper surfaces US of the side walls 6. This prevents, when the flexible substrate 20 is bonded to the upper surface ends EJ later, leakage of a drive signal due to a short circuit or insulation failure between the common wiring electrode 21*b* and the drive electrode 7 in the dummy groove 5*b* or between the individual wiring electrode 21*a* on the flexible substrate 20 and the drive electrode 7 in the ejection groove 5*a*.

Figure 14B:
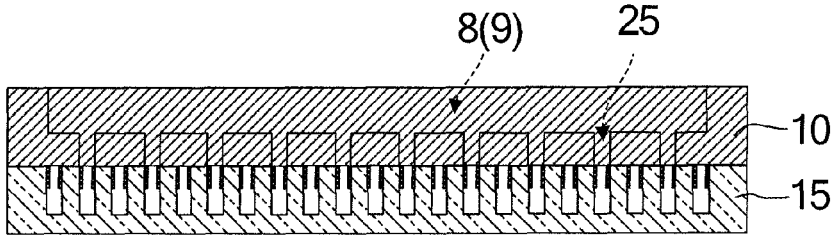

FIG. 14B is an explanatory diagram of the cover plate bonding step S4 in which the cover plate 10 is bonded to the front surface of the piezoelectric substrate 15 (upper surfaces US). The supply port 8, the discharge port 9, and the slits 25 are formed in advance in the cover plate 10. The cover plate 10 is bonded using an adhesive to the front surface of the piezoelectric substrate 15 (upper surfaces US) so that the upper surface ends of the piezoelectric substrate 15 are exposed. In the bonding, the slits 25 are caused to communicate with the ejection grooves 5*a* and the supply port 8 and the discharge port 9 are caused to be closed to the dummy grooves 5*b*. It is preferred that, as the cover plate 10, a material having a thermal expansion coefficient substantially equal to that of the piezoelectric substrate 15 be used. In this embodiment, PZT ceramic is used as the cover plate 10.

Figure 14C:
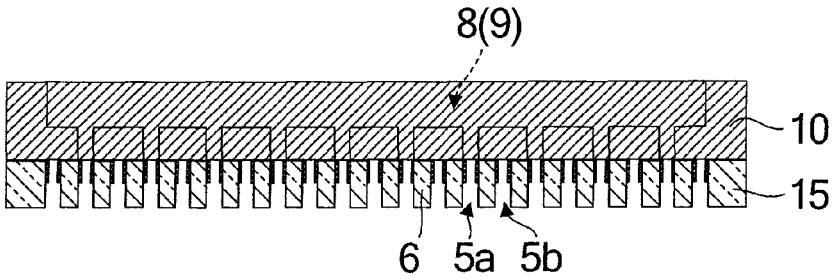

FIG. 14C is an explanatory diagram of the grinding step S5 in which the rear surface which is opposite to the front surface of the piezoelectric substrate 15 is ground to cause the grooves 5 to open to the rear surface side. A grinder or a polishing plate is used to grind the piezoelectric substrate 15 from the rear surface side to cause the ejection grooves 5*a* and the dummy grooves 5*b* to open to the rear surface side. This separates the side walls 6 from one another, but the upper surfaces US of the side walls 6 are bonded to the cover plate 10, and thus, the side walls 6 do not fall down to pieces.

Figure 14D:
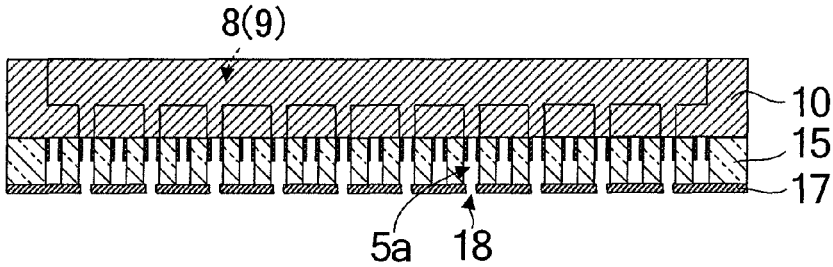

FIG. 14D is an explanatory diagram of the reinforcing plate bonding step S51 in which the reinforcing plate 17 is bonded to the rear surface side of the piezoelectric substrate 15. The reinforcing plate 17 is bonded using an adhesive to the piezoelectric substrate 15, that is, the rear surface side of the side walls 6. The reinforcing plate 17 is provided with the through holes 18 for communicating with the ejection grooves 5*a* substantially in the middle between the supply port 8 and the discharge port 9 in the cover plate 10. The through holes 18 may be formed before the reinforcing plate 17 is bonded to the piezoelectric substrate 15 or after the reinforcing plate 17 is bonded to the piezoelectric substrate 15. As the reinforcing plate 17, a metal or ceramic may be used. When a metal such as Mo or machinable ceramic is used, the thermal expansion coefficient may become substantially equal to that of PZT ceramic, which enables improvement in durability to withstand thermal change. With the provision of the reinforcing plate 17, reduction of the conversion efficiency in converting deformation of the side wall 6 into pressure applied to liquid may be prevented. Note that, when ceramic is used as the reinforcing plate 17, a ceramic plate having through holes or concave portions formed therein which correspond to the ejection grooves 5*a* may be bonded to the rear surface of the piezoelectric substrate 15, and then the ceramic plate may be ground from the rear surface side to be a thin film, thereby forming the reinforcing plate 17. This makes it easier to handle the reinforcing plate 17 and also improves the planarity. When machinable ceramic which is excellent in processability in grinding is used, grinding from the rear surface side is facilitated.

Figure 14E:
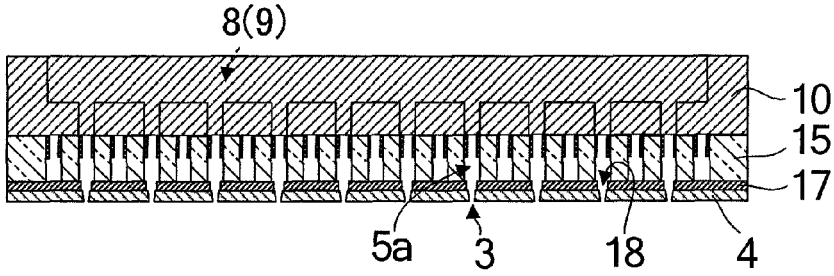

FIG. 14E is an explanatory diagram of the nozzle plate bonding step S6 in which the nozzle plate 4 is bonded to the reinforcing plate 17 on the side opposite to the side walls 6. The nozzle plate 4 is provided with the nozzles 3 at locations corresponding to the through holes 18 in the reinforcing plate 17. The nozzles 3 may be formed before the nozzle plate 4 is bonded to the reinforcing plate 17, or after the nozzle plate 4 is bonded to the reinforcing plate 17 (nozzle forming step).

Formation of the nozzles 3 after the nozzle plate 4 is bonded to the reinforcing plate 17 facilitates alignment. The nozzles 3 are formed by applying a laser from the outside.

Figure 15A:
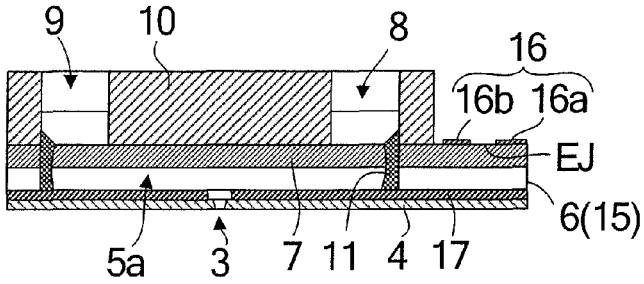
FIGS. 15A to 15C are explanatory diagrams for illustrating the method of manufacturing a liquid jet head according to the eighth embodiment of the present invention.

FIG. 15A is an explanatory diagram of the sealing material placing step S61 in which the sealing materials 11 are placed for closing the ejection grooves 5*a* outside the communicating portions with the supply port 8 and the discharge port 9. The sealing materials 11 close the ejection grooves 5*a* to prevent liquid from leaking to the outside. In FIG. 15A, the sealing materials 11 are provided on the supply port 8 side and on the discharge port 9 side, respectively, but the sealing materials 11 may be provided on the end side of the cover plate 10. Note that, as illustrated in FIG. 15A, the extracting electrodes 16 are formed on the upper surface ends EJ of the side walls 6 (piezoelectric substrate 15). The individual extracting electrodes 16*a* are placed on the end side of the side walls 6 (piezoelectric substrate 15), while the common extracting electrodes 16*b* are placed on the end side of the cover plate 10.

Figure 15B:
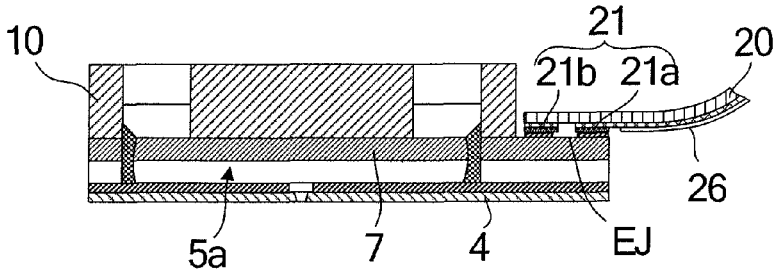

FIG. 15B is an explanatory diagram of the flexible substrate bonding step S62 in which the flexible substrate 20 is bonded to the upper surface ends EJ. The wiring electrodes 21 including the individual wiring electrodes 21*a* and the common wiring electrode 21*b* are formed in advance in the flexible substrate 20. The flexible substrate 20 is bonded to the upper surface ends EJ of the piezoelectric substrate 15 so that the individual wiring electrodes 21*a* and the corresponding individual extracting electrodes 16*a* are electrically connected and the common wiring electrode 21*b* and the common extracting electrodes 16*b* are electrically connected. The wiring electrodes 21 and the extracting electrodes 16 are bonded to each other, for example, via an anisotropic conductor. The wiring electrodes 21 on the flexible substrate 20 are covered with and protected by the protective film 26 in a region other than the bonded region. Further, the flexible substrate 20 is bonded to the upper surface ends EJ on the side opposite to the nozzle plate 4 at which liquid is ejected, and thus, the thickness of the bonded portion is not limited and the design flexibility increases.

Figure 15C:
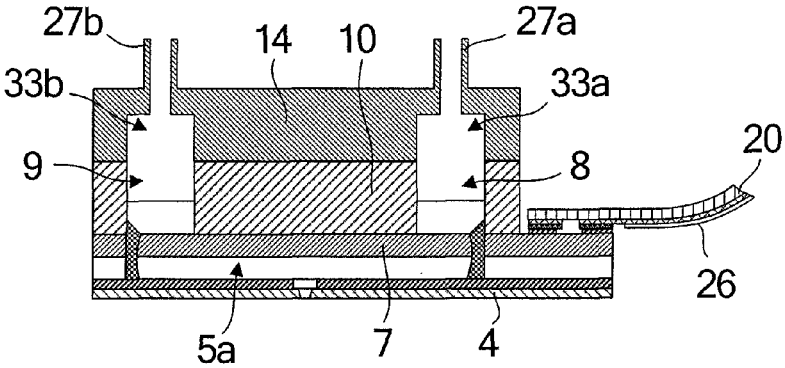

FIG. 15C is an explanatory diagram of the flow path member bonding step S63 in which the flow path member 14 is bonded to the upper surface of the cover plate 10. A supply flow path 33*a*, the supply joint 27*a* which communicates with the supply flow path 33*a*, a discharge flow path 33*b*, and the discharge joint 27*b* which communicates with the discharge flow path 33*b* are formed in advance in the flow path member 14. In the bonding, the supply flow path 33*a* in the flow path member 14 is aligned with the supply port 8 in the cover plate 10 and the discharge flow path 33*b* in the flow path member 14 is aligned with the discharge port 9 in the cover plate 10. The supply joint 27*a* and the discharge joint 27*b* in the flow path member 14 are placed in the upper surface of the flow path member 14, and thus, piping may be concentrated and the structure may be downsized.

It is noted that the method of manufacturing the liquid jet head 1 according to the present invention is not limited to forming the ejection grooves 5*a* and the dummy grooves 5*b* alternately so as to be in parallel with one another, but all the grooves 5 may be the ejection grooves 5*a* and the nozzles 3 and the through holes 18 may be formed so as to correspond to the respective ejection grooves 5*a*. Further, the piezoelectric substrate 15 used may be formed by laminating two piezoelectric substrates in which the directions of polarization are opposite to each other, and, in the conductive film forming step S2, instead of oblique deposition, sputtering or the like may be used to form the conductive film on the entire wall surfaces WS of the side walls 6.

What is claimed is:

1. A liquid jet head, comprising:

a nozzle plate including nozzles for ejecting liquid;

side walls placed over the nozzle plate, the side walls forming grooves having a fixed depth in a longitudinal direction thereof;

drive electrodes formed on wall surfaces of the side walls;

a cover plate placed on upper surfaces of the side walls, the cover plate having a supply port for supplying liquid to the grooves and a discharge port for discharging liquid from the grooves; and sealing materials for closing the grooves outside communicating portions between the grooves and the supply port and between the grooves and the discharge port to prevent leakage of liquid from the grooves.

2. The liquid jet head according to claim 1, wherein:

the cover plate is placed on the upper surfaces of the side walls under a state in which upper surface ends in the longitudinal direction of the side walls are exposed; and the liquid jet head further comprises extracting electrodes formed on the upper surface ends, the extracting electrodes being electrically connected to the drive electrodes.

3. The liquid jet head according to claim 2, further comprising a flexible substrate having a pattern of wiring electrodes formed on a surface thereof, wherein the flexible substrate is bonded to the upper surface ends and the wiring electrodes are electrically connected to the extracting electrodes.

4. The liquid jet head according to claim 3, wherein:

the grooves comprise:

ejection grooves for ejecting liquid; and dummy grooves which avoid ejecting liquid;

the supply port and the discharge port communicate with the ejection grooves; and the ejection grooves and the dummy grooves are placed alternately so as to be in parallel with one another.

5. The liquid jet head according to claim 3, further comprising a reinforcing plate placed between the nozzle plate and the side walls, the reinforcing plate including through holes communicating with the nozzles, respectively.

6. The liquid jet head according to claim 3, wherein the side walls have a laminated structure of laminated piezoelectric bodies which are polarized in directions opposite to each other.

7. A liquid jet apparatus, comprising:

the liquid jet head according to claim 3;

a moving mechanism for reciprocating the liquid jet head;

a liquid supply tube for supplying liquid to the liquid jet head; and a liquid tank for supplying the liquid to the liquid supply tube.

8. The liquid jet head according to claim 2, wherein:

the grooves comprise:

ejection grooves for ejecting liquid; and dummy grooves which avoid ejecting liquid;

the supply port and the discharge port communicate with the ejection grooves; and the ejection grooves and the dummy grooves are placed alternately so as to be in parallel with one another.

9. The liquid jet head according to claim 2, further comprising a reinforcing plate placed between the nozzle plate and the side walls, the reinforcing plate including through holes communicating with the nozzles, respectively.

10. The liquid jet head according to claim 2, wherein the side walls have a laminated structure of laminated piezoelectric bodies which are polarized in directions opposite to each other.

11. The liquid jet head according to claim 1, wherein:

the grooves comprise:

ejection grooves for ejecting liquid; and dummy grooves which avoid ejecting liquid;

the supply port and the discharge port communicate with the ejection grooves; and the ejection grooves and the dummy grooves are placed alternately so as to be in parallel with one another.

12. The liquid jet head according to claim 11, wherein the supply port and the discharge port are open to the ejection grooves and are closed to the dummy grooves.

13. The liquid jet head according to claim 1, further comprising a reinforcing plate placed between the nozzle plate and the side walls, the reinforcing plate including through holes communicating with the nozzles, respectively.

14. The liquid jet head according to claim 1, wherein the side walls have a laminated structure of laminated piezoelectric bodies which are polarized in directions opposite to each other.

15. The liquid jet head according to claim 1, wherein:

the cover plate is placed on the upper surfaces of the side walls under a state in which upper surface ends in the longitudinal direction of the side walls are exposed;

the liquid jet head further comprises extracting electrodes formed on the upper surface ends, the extracting electrodes being electrically connected to the drive electrodes;

the grooves comprise:

ejection grooves for ejecting liquid; and dummy grooves which avoid ejecting liquid;

the supply port and the discharge port communicate with the ejection grooves;

the ejection grooves and the dummy grooves are placed alternately so as to be in parallel with one another;

the extracting electrodes comprise:

common extracting electrodes electrically connected to the drive electrodes formed on the wall surfaces on the ejection groove side of the side walls forming the ejection grooves; and individual extracting electrodes electrically connected to the drive electrodes formed on the wall surfaces on the dummy groove side of the side walls; and the individual extracting electrodes are placed on an end side of the upper surface ends of the side walls and the common extracting electrodes are placed on the cover plate side of the upper surface ends of the side walls.

16. The liquid jet head according to claim 15, wherein:

the drive electrodes extend to ends in the longitudinal direction of the side walls;

upper ends of the drive electrodes formed on the wall surfaces on the ejection groove side are formed to be lower than the upper surface ends in a depth direction of the grooves on the end side of the side walls; and upper ends of the drive electrodes formed on the wall surfaces on the dummy groove side are formed to be lower than the upper surface ends in the depth direction of the grooves on the cover plate side with respect to the ends of the side walls.

17. A liquid jet head according to claim 15, wherein:

edges formed by the wall surfaces on the ejection groove side of the side walls and the upper surface ends are beveled on the end side of the side walls; and edges formed by the wall surfaces on the dummy groove side of the side walls and the upper surface ends are beveled on the cover plate side with respect to the ends of the side walls.

18. The liquid jet head according to claim 15, further comprising a flexible substrate comprising:

a common wiring electrode formed on an edge side of the flexible substrate; and individual wiring electrodes formed on an inner side of the common wiring electrode, wherein the flexible substrate is bonded to the upper surface ends so that the common wiring electrode is electrically connected to the common extracting electrodes and the individual wiring electrodes are electrically connected to the individual extracting electrodes.

19. The liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

20. The liquid jet head according to claim 1, wherein a slit is formed in each of the supply port and the discharge port, the supply port and the discharge port communicating with the grooves via the corresponding slit; and wherein the sealing materials are formed inside the respective slits.

21. The liquid jet head according to claim 20, wherein the sealing materials are inclined with respect to wall surfaces of the respective slits.

* * * * *